US011426746B2

(12) United States Patent
Sugiura

(10) Patent No.: US 11,426,746 B2
(45) Date of Patent: Aug. 30, 2022

(54) PRESSURE WASHER

(71) Applicant: MAKITA CORPORATION, Anjo (JP)

(72) Inventor: Hideaki Sugiura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 228 days.

(21) Appl. No.: 16/697,277

(22) Filed: Nov. 27, 2019

(65) Prior Publication Data

US 2020/0171522 A1 Jun. 4, 2020

(30) Foreign Application Priority Data

Nov. 29, 2018 (JP) ..... JP2018-223990

(51) Int. Cl.

| | |
|---|---|
| ***B05B 9/04*** | (2006.01) |
| ***B05B 9/043*** | (2006.01) |
| ***B08B 3/02*** | (2006.01) |
| ***B08B 13/00*** | (2006.01) |

(52) U.S. Cl.

CPC ..... *B05B 9/0426* (2013.01); *B05B 9/043* (2013.01); *B08B 3/02* (2013.01); *B08B 3/026* (2013.01); *B08B 13/00* (2013.01); *B08B 2203/027* (2013.01); *B08B 2203/0223* (2013.01)

(58) Field of Classification Search

CPC ..... B05B 9/0426; B05B 9/043; B08B 3/02; B08B 3/026; B08B 13/00; B08B 2203/0223; B08B 2203/027

USPC ..... 134/184

See application file for complete search history.

(56) References Cited

U.S. PATENT DOCUMENTS

| | | | | |
|---|---|---|---|---|
| 2004/0011886 | A1* | 1/2004 | Lawson | A47L 11/4083 239/302 |
| 2007/0186368 | A1* | 8/2007 | Field | A47L 11/4011 15/320 |
| 2015/0050169 | A1 | 2/2015 | Horie et al. | |
| 2016/0016207 | A1* | 1/2016 | Horie | F16L 25/0018 134/174 |

FOREIGN PATENT DOCUMENTS

| | | | |
|---|---|---|---|
| JP | 59-114858 | U | 8/1984 |
| JP | 2004-195043 | A | 7/2004 |
| JP | 2005-160658 | A | 6/2005 |
| JP | 2011-235254 | A | 11/2011 |
| JP | 2013-169486 | A | 9/2013 |
| JP | 2016-107172 | A | 6/2016 |

OTHER PUBLICATIONS

Notice of Reasons for Refusal dated Jul. 5, 2022 from the Japanese Patent Office in Japanese Application No. 2018-223990.

* cited by examiner

*Primary Examiner* — Tinsae B Ayalew
(74) *Attorney, Agent, or Firm* — Sughrue Mion, PLLC

(57) ABSTRACT

A working machine may be provided with: a case configured to store water therein; and a working machine body configured to discharge water supplied from the case, in which the working machine body is detachably mounted on an upper surface of the case.

17 Claims, 22 Drawing Sheets

PRESSURE WASHER

CROSS-REFERENCE TO RELATED APPLICATION

This application claims priority to Japanese patent application No. 2018-223990, filed on Nov. 29, 2018, the entire contents of which are incorporated herein by reference.

TECHNICAL FIELD

The art disclosed herein relates to a working machine.

BACKGROUND

Japanese Patent Application Publication No. 2016-107172 describes a working machine that includes a case configured to store water therein, and a working machine body configured to discharge water supplied from the case. In the above working machine, the case is detachably mounted on an upper surface of the working machine body.

SUMMARY

In a configuration in which a case configured to store water therein is mounted on an upper surface of a working machine body, a weight of the case storing the water needs to be supported by the working machine body. Due to this, if a capacity of the water stored in the case is to be increased, strength and stiffness of the working machine body need to be enhanced to compensate for that increase, as a result of which a size and weight of the working machine body also are increased. The description herein provides an art configured to increase a capacity of water stored in a case without increasing a size and weight of a working machine body.

The description herein discloses a working machine. The working machine may comprise: a case configured to store water therein; and a working machine body configured to discharge water supplied from the case. The working machine body may be detachably mounted on an upper surface of the case.

According to the above configuration, since the working machine body is mounted on the upper surface of the case configured to store water therein, weight of the case storing water therein is not supported by the working machine body. Thus, even when the capacity of water stored in the case is increased, the strength and stiffness of the working machine body do not need to be increased. The capacity of the water stored in the case can be increased without increasing the size and weight of the working machine body.

DETAILED DESCRIPTION

Figure 1:
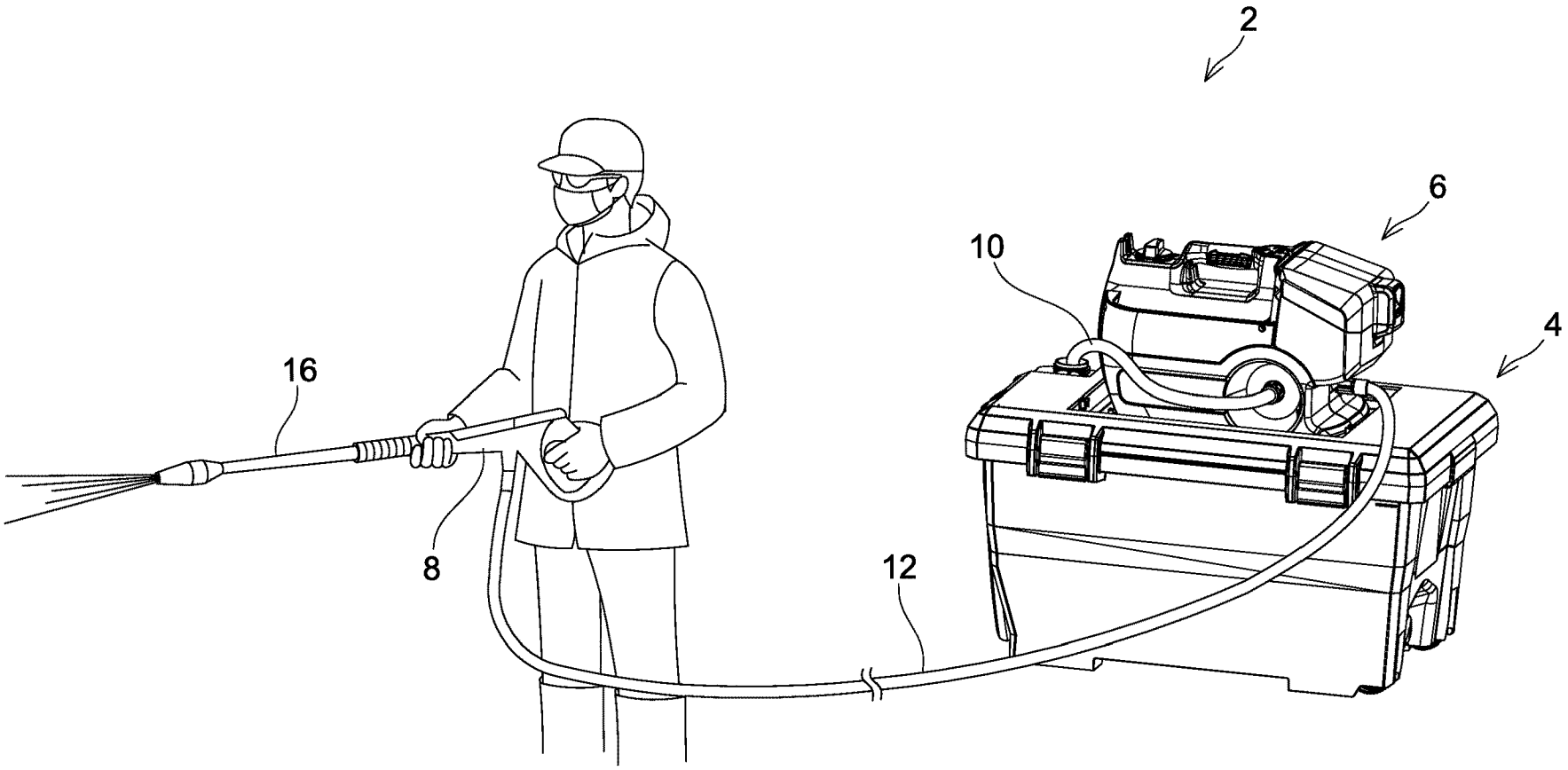
FIG. 1 is a drawing schematically showing a pressure washer 2 according to an embodiment in use.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved working machines, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more aspects of the present teachings, a working machine may comprise: a case configured to store water therein; and a working machine body configured to discharge water supplied from the case. The working machine body may be detachably mounted on an upper surface of the case.

According to the above configuration, since the washer body is mounted on the upper surface of the case that stores water, the washer body does not support weight of the case storing water. Thus, even when a capacity of water stored in the case is increased, strength and stiffness of the washer body itself do not have to be increased. The capacity of water stored in the case can be increased without increasing the size and weight of the washer body.

In one or more aspects of the present teachings, in the working machine, when the case is inclined with respect to a horizontal state, force that prevents the working machine body from moving in a direction of detaching the working machine body from the case may act on the working machine body more strongly than when the case is in the horizontal state.

According to the above configuration, in a case where the case is inclined in the state where the washer body is mounted on the upper surface of the case, force that prevents the washer body from moving in the direction of detaching the washer body from the case acts on the washer body. Due to this, the washer body mounted on the upper surface of the case can be prevented from falling off the case when the case is inclined. Further, according to the above configuration, when the case is in the horizontal state, the force that prevents the washer body from moving in the direction of detaching the washer body from the case does not act on the washer body. Due to this, attachment and detachment of the washer body can be easily performed when the case is in the horizontal state.

In one or more aspects of the present teachings, one of the working machine body and the case may include an engaging wall. Another of the working machine body and the case may include an engaging pawl configured to engage with the engaging wall. When the case is in the horizontal state, weight of the working machine body may not act in a direction of pressing the engaging wall against the engaging pawl. When the case is inclined with respect to the horizontal state, the weight of the working machine body may act in the direction of pressing the engaging wall against the engaging paw.

According to the above configuration, upon detaching the working machine body from the case, the working machine body needs to be moved in a direction of detaching the engaging wall from the engaging pawl. At this occasion, if the case is in the inclined state, the weight (self-weight) of the working machine body acts in a direction that presses the engaging wall against the engaging pawl, i.e. the direction opposite to the direction of detaching the working machine body from the case. Due to this, the weight of the working machine body functions as the force that prevents the working machine body from moving in the direction of detaching the working machine body from the case. Further, in the above configuration, when the case is in the horizontal state, the weight of the working machine body does not act in the direction that presses the engaging wall against the engaging pawl, thus the weight of the working machine body does not function as the force that prevents the working machine body from moving in the direction of detaching the working machine body from the case. According the above configuration, with a simple structure, the force that prevents the working machine body from moving in the direction of detaching the working machine body from the case can be made to act on the working machine body more strongly when the case is in the inclined state relative to the horizontal state than when the case is in the horizontal state.

In one or more aspects of the present teachings, the case may include: a case body having an opening on an upper side thereof; and a case cover openably attached to the case body and configured to cover the opening of the case body. The working machine body may be detachably mounted on an upper surface of the case cover.

According to the above configuration, with the case in the state of having the working machine body detached therefrom, the user can open/close the case cover while remaining standing in a state where the case body is placed on the ground.

In one or more aspects of the present teachings, the working machine may comprise: a case configured to store water therein; a working machine body configured to discharge water supplied from the case; and an accessory. In a state where water is not stored in the case, the working machine body and the accessory may be capable of being accommodated inside the case. The case may include a drain port. The accessory may include a battery configured to supply electric power to the working machine body. When the working machine body and the battery are accommodated inside the case, the battery may be located above the drain port.

According to the above configuration, even when water remains at a spot lower than the drain port inside the case after the water has been drained from the case storing the water through the drain port and the working machine body and accessorie(s) have been accommodated inside the case, the battery can be prevented from being splashed with water because the battery is arranged at a spot higher than the drain port.

In one or more aspects of the present teachings, the accessory may further include a charger configured to charge the battery. When the working machine body and the charger are accommodated inside the case, the charger may be located above the drain port.

According to the above configuration, even when water remains at a spot lower than the drain port inside the case after the water has been drained from the case storing the water through the drain port and the working machine body and accessorie(s) have been accommodated inside the case, the charger can be prevented from being splashed with water because the charger is arranged at a spot higher than the drain port.

In one or more aspects of the present teachings, a support configured capable of supporting the charger above the drain port may be provided inside the case.

According to the above configuration, when the working machine body and accessorie(s) are accommodated in the case after water has been drained from the case storing water through the drain port, the charger can be arranged surely at the spot higher than the drain port by supporting the charger with the support.

In one or more aspects of the present teachings, a positioning groove may be provided on one of a lower surface of the working machine body and a bottom surface of the case. A positioning projection configured to enter into the positioning groove may be provided on another of the lower surface of the working machine body and the bottom surface of the case.

When the working machine body is placed on the bottom surface of the case in a correct orientation with the positioning groove and the positioning projection being aligned with each other, a wall surface of the case may not interfere with the working machine body. When the working machine body is placed on the bottom surface of the case in an incorrect orientation with the positioning groove and the positioning projection being aligned with each other, the wall surface of the case may interfere with the working machine body.

In a case where the working machine body and the accessorie(s) are accommodated in the case, the accessorie(s) are accommodated in the space defined between the working machine body placed on the bottom surface of the case and the wall surface of the case. Due to this, if the orientation of the working machine body is different when the working machine body is placed on the bottom surface of the case, a shape of the space in which the accessorie(s) can be accommodated also becomes different. Due to this, if the working machine body is placed on the bottom surface of the case in an incorrect orientation, there is a risk that all the accessories cannot be accommodated in the case. According to the above configuration, the working machine body can be prevented from being placed on the bottom surface of the case in the incorrect orientation, thus the accessories can be surely accommodated within the case.

In one or more aspects of the present teachings, the working machine body may include: a pump mechanism configured to pump water supplied from a water inlet to a water outlet; an electric motor configured to drive the pump mechanism; a housing configured to accommodate the pump mechanism and the electric motor therein; and a shoulder belt attached to the housing.

According to the above configuration, the user can carry the working machine body by strapping the shoulder belt over his/her shoulder. The working machine body can be configured carriable without occupying one hand of the user.

In one or more aspects of the present teachings, the housing may include an accessory box configured to accommodate an accessory therein.

According to the above configuration, the user can carry also the accessorie(s) accommodated in the accessory box together with the working machine body by carrying the working machine body by strapping the shoulder belt over his/her shoulder.

In one or more aspects of the present teachings, the housing may include: a first hook to which one end of the shoulder belt is detachably attached, and a second hook to which another end of the shoulder belt is detachably attached.

According to the above configuration, the shoulder belt can be detached from the housing when the shoulder belt is unnecessary.

In one or more aspects of the present teachings, the first hook may be disposed on a front-upper side from a center of gravity of the working machine body. The second hook may be disposed on a rear-upper side from the center of gravity of the working machine body.

According to the above configuration, upon the user carrying the working machine body by strapping the shoulder belt over his/her shoulder, the working machine body can be easily balanced in the front-rear direction.

In one or more aspects of the present teachings, a position of the center of gravity of the working machine body in a left-right direction may be located within a range of 1.5 times a width of the first hook in the left-right direction from a centerline of the first hook, and within a range of 1.5 times a width of the second hook in the left-right direction from a centerline of the second hook.

According to the above configuration, upon the user carrying the working machine body by strapping the shoulder belt over his/her shoulder, the working machine body can be easily balanced in the left-right direction.

In one or more aspects of the present teachings, the case may include: a case body configured to store water therein; a wheel provided on the case body; and a handle provided on the case body.

According to the above configuration, even when the capacity of water stored in the case body is increased and thus the weight of the case body storing water becomes significantly large, the user can easily carry the case body by gripping the handle without fully lifting the case body up since the wheel is provided on the case body.

In one or more aspects of the present teachings, the wheel may be provided in vicinity of one end of the case body. The handle may be provided in vicinity of another end of the case body. When the case body is placed on a ground, the wheel may be separated from the ground. When the other end of the case body is lifted upward, the wheel may come into contact with the ground.

According to the above configuration, since the wheel is separated from the ground in the state where the case body is placed on the ground, the case body can be stably placed. Further, according to the above configuration, the wheel comes into contact with the ground when the user lifts the other end of the case body upward by gripping the handle, by which the user can easily carry the case body.

In one or more aspects of the present teachings, the case body may include a drain port provided in vicinity of the one end of the case body According to the above configuration, upon draining the water stored in the case body from the drain port, by the user lifting the other end of the case body upward by gripping the handle, the draining of water from the drain port arranged on one end of the case body can be accelerated.

In one or more aspects of the present teachings, the case may include: a case cover which is openably attached to the case body and configured to cover an opening provided on an upper side of the case body; and a sealer disposed at a spot where the case cover and the case body contact each other.

According to the above configuration, the user can open/close the case cover while remaining standing in the state where the case body is placed on the ground. Further, according to the above configuration, even when the other end of the case body is lifted upward by gripping the handle in the state of the case body storing the water, since the sealer is arranged at the spot where the case cover and the case body are in contact with each other, water leaks from a gap between the case cover and the case body can be suppressed.

In one or more aspects of the present teachings, the working machine may comprise: the case; and a working machine body configured to discharge water supplied from the case. The working machine body may be configured mountable on the upper surface of the case. The case may be carriable without fully lifting the case in a state where the working machine body is mounted on the upper surface of the case.

According to the above configuration, the case storing water and the working machine body can be carried together in the state where the working machine body is mounted on the upper surface of the case.

In one or more aspects of the present teachings, in a state where water is not stored in the case, the working machine body may be able to be accommodated inside the case. The case may be carriable without fully lifting the case in a state where the working machine body is accommodated inside the case.

According to the above configuration, the case and the working machine body can be carried together in the state where the working machine body is accommodated within the case.

In one or more aspects of the present teachings, the working machine may comprise: the case; and the working machine body configured to discharge water supplied from the case. In a state where water is not stored in the case, the working machine body may be able to be accommodated inside the case. The case may be carriable without fully lifting the case in a state where the working machine body is accommodated inside the case.

According to the above configuration, the case and the working machine body can be carried together in the state where the working machine body is accommodated inside the case.

Embodiment

Figure 15:
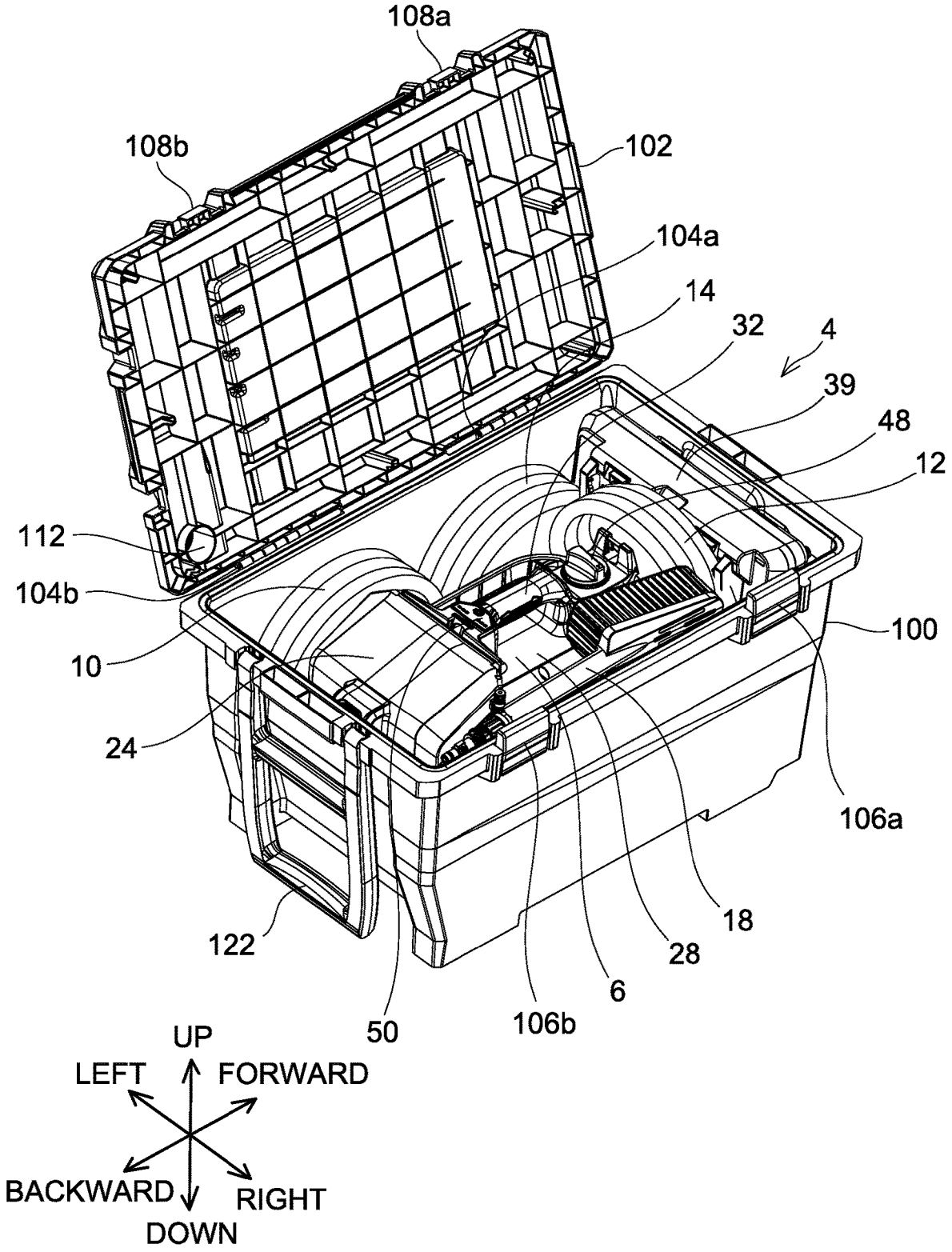
FIG. 15 is a perspective view seeing the pressure washer 2 according to the embodiment from the rear-left upper side in a state of having accommodated the washer body 6, a trigger gun 8, and various accessories within the accommodation case 4.
Figure 16:
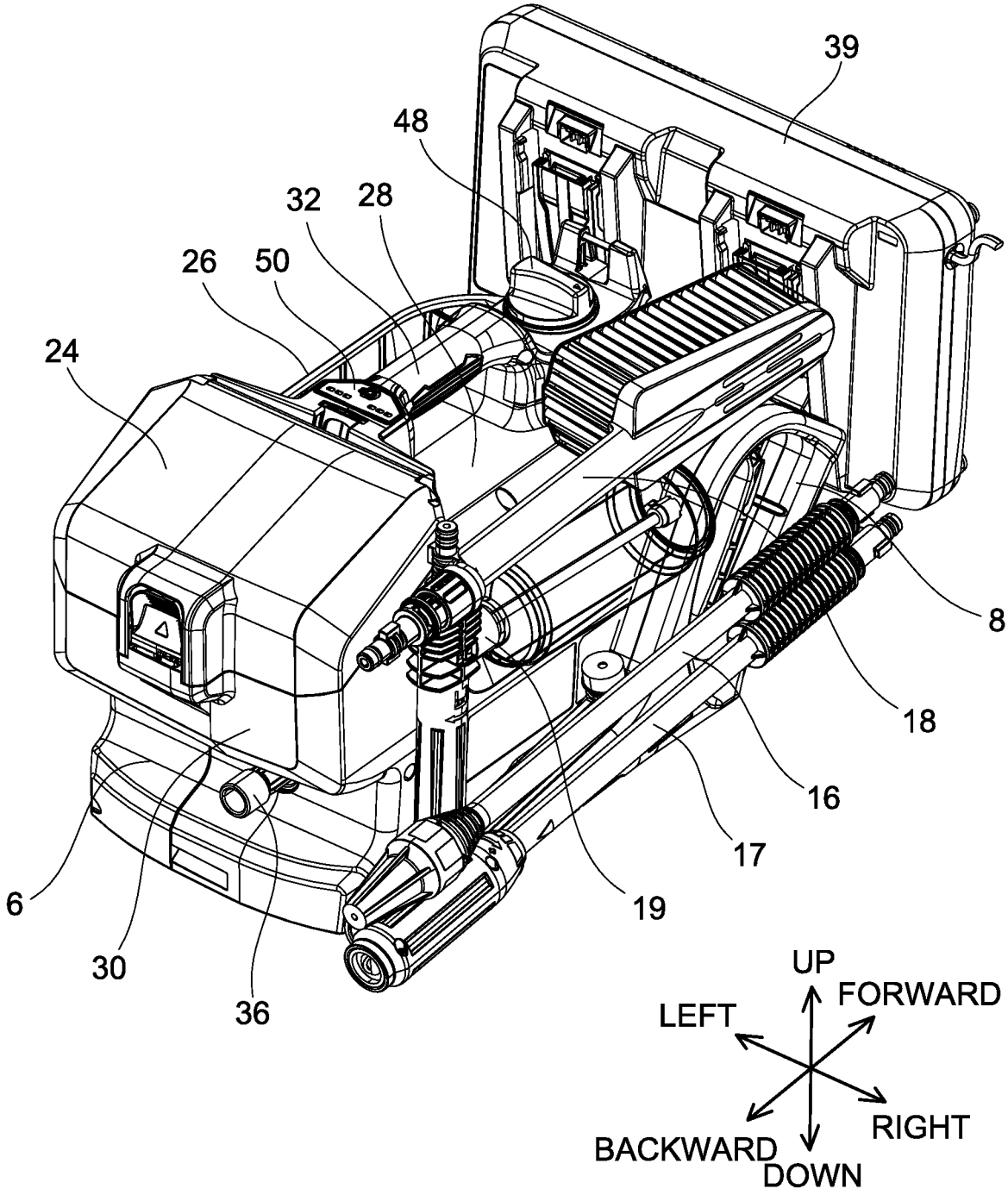
FIG. 16 is a perspective view showing an arrangement of the washer body 6, the trigger gun 8, and the various accessories accommodated within the accommodation case 4 in the pressure washer 2 according to the embodiment.

A pressure washer 2 of an embodiment will be described with reference to the accompanying drawings. As shown in FIG. 1, the pressure washer 2 comprises an accommodation case 4, a washer body 6, and a trigger gun 8. As shown in FIGS. 15 and 16, the accommodation case 4 is configured to accommodate the washer body 6, the trigger gun 8, and various accessories to be described later when the pressure washer 2 is not in use. Further, as shown in FIG. 1, when the pressure washer 2 is in use, the accommodation case 4 is configured to store water therein after all the accessories accommodated therein have been taken out. The washer body 6 is detachably mounted on an upper surface of the accommodation case 4 when the pressure washer 2 is in use. The washer body 6 is configured to draw out water from the accommodation case 4 through a self-supply hose 10, and supply pressurized water through a pressurizing hose 12 to the trigger gun 8. The washer body 6 can be connected to a faucet of a water supply system via a pressure-resistant hose 14 (see FIG. 15). In this case, the washer body 6 is configured to pressurize water supplied through the pressure-resistant hose 14 from the water supply system and supply the same to the trigger gun 8 through the pressurizing hose 12. A jet nozzle 16 is attached to the trigger gun 8. The trigger gun 8 is configured to switch between a state of supplying water to the jet nozzle 16 and a state of cutting off the supply of water to the jet nozzle 16 according to an operation by a user. The jet nozzle 16 is configured to jet the water supplied from the trigger gun 8 from its tip in a swirling flow having high linear propulsion. Alternatively, instead of the jet nozzle 16, various types of attachments, such as a spray lance 17 (see FIG. 16), a washing brush 18 (see FIG. 16), and a nozzle 19 equipped with a detergent tank (see FIG. 16), can be attached to the trigger gun 8. The spray lance 17 is configured to jet the water supplied from the trigger gun 8 from its tip, scattering the water in a full conical pattern. The washing brush 18 is configured to spray the water supplied from the trigger gun 8 between its brushes. The nozzle 19 with the detergent tank is configured to mix detergent with the water supplied from the trigger gun 8 and sprays a mixture thereof.

Figure 2:
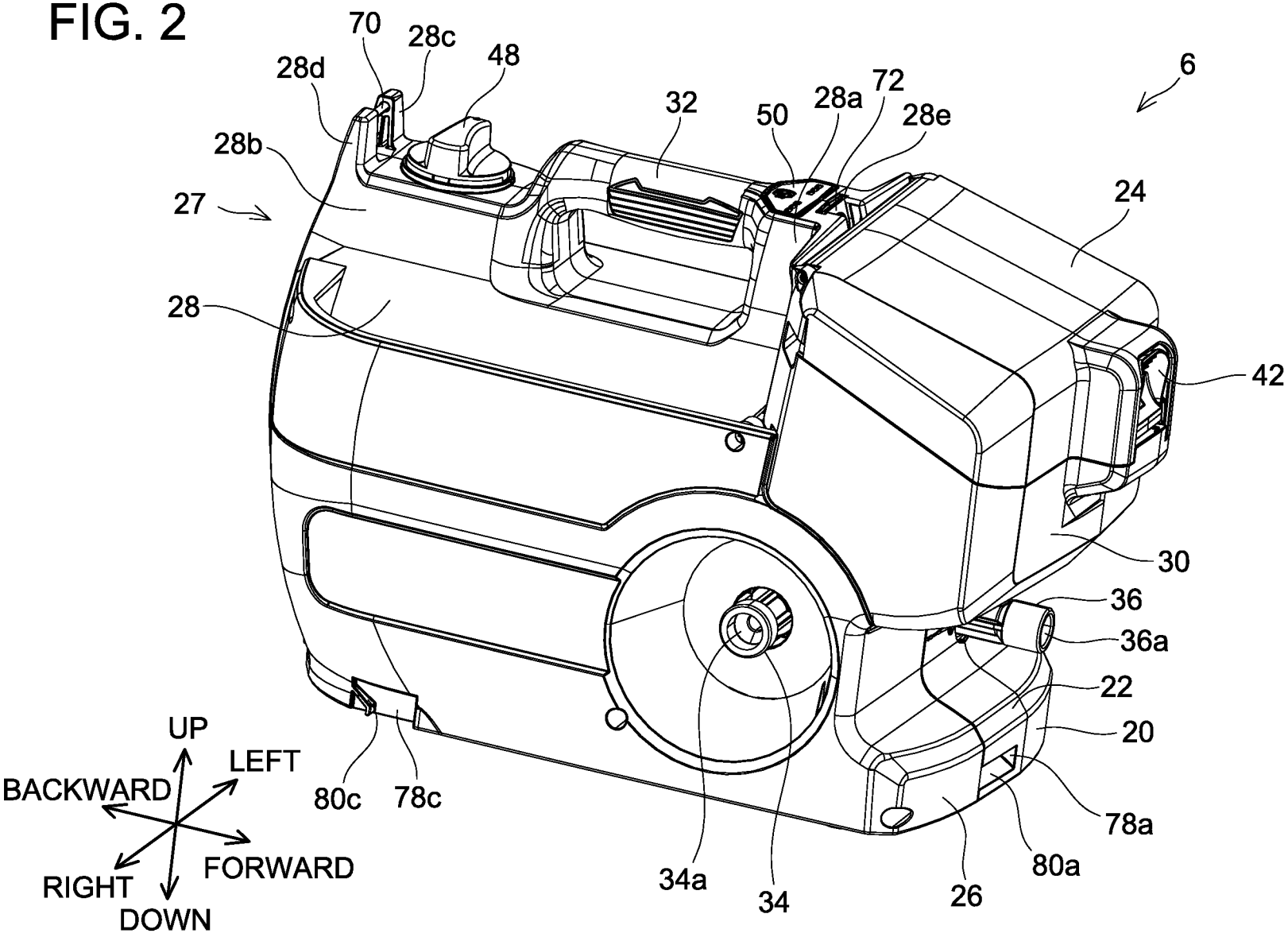
FIG. 2 is a perspective view seeing a washer body 6 according to the embodiment from a front-right upper side.
Figure 3:
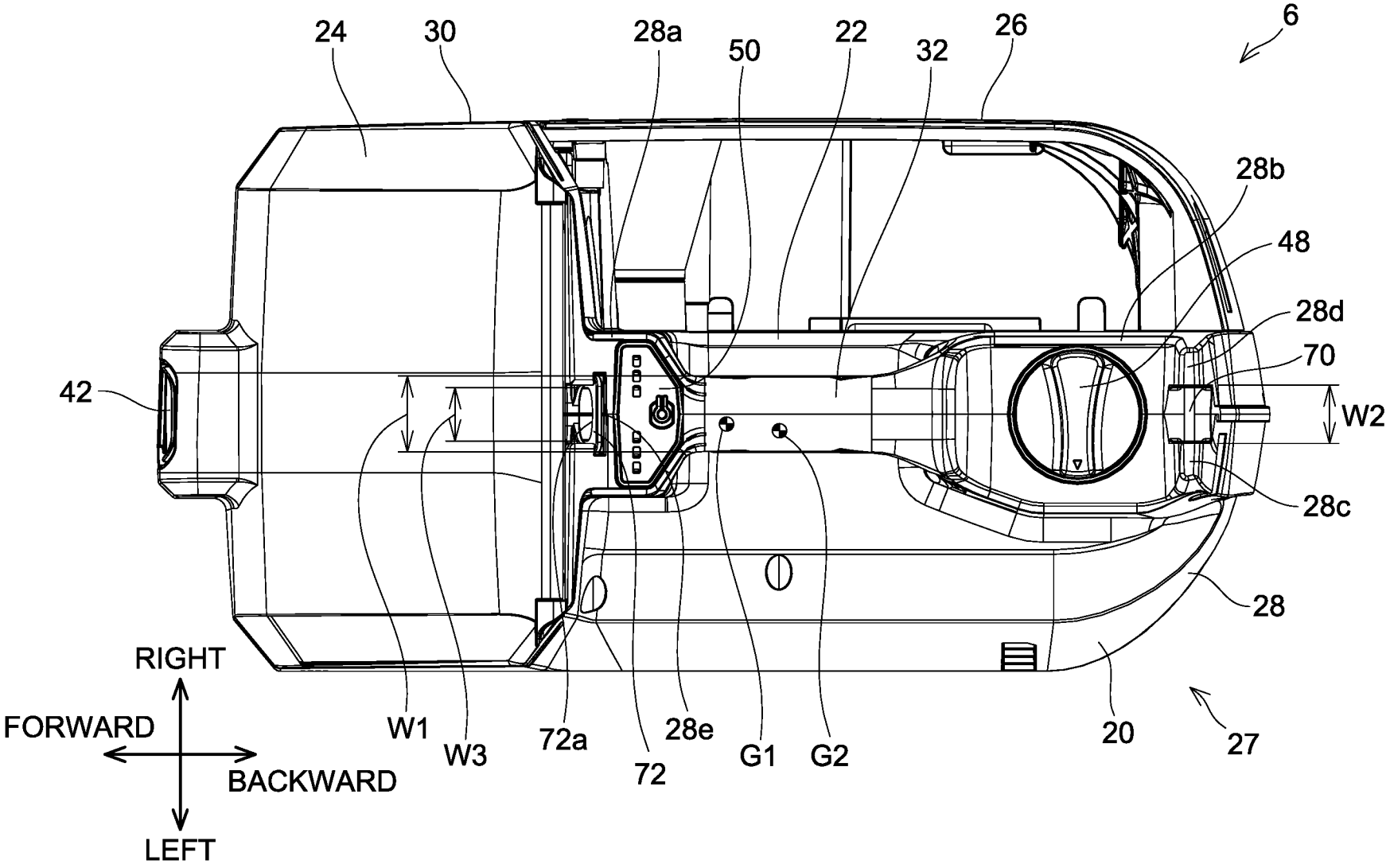
FIG. 3 is a plan view seeing the washer body 6 according to the embodiment from an upper side.
Figure 4:
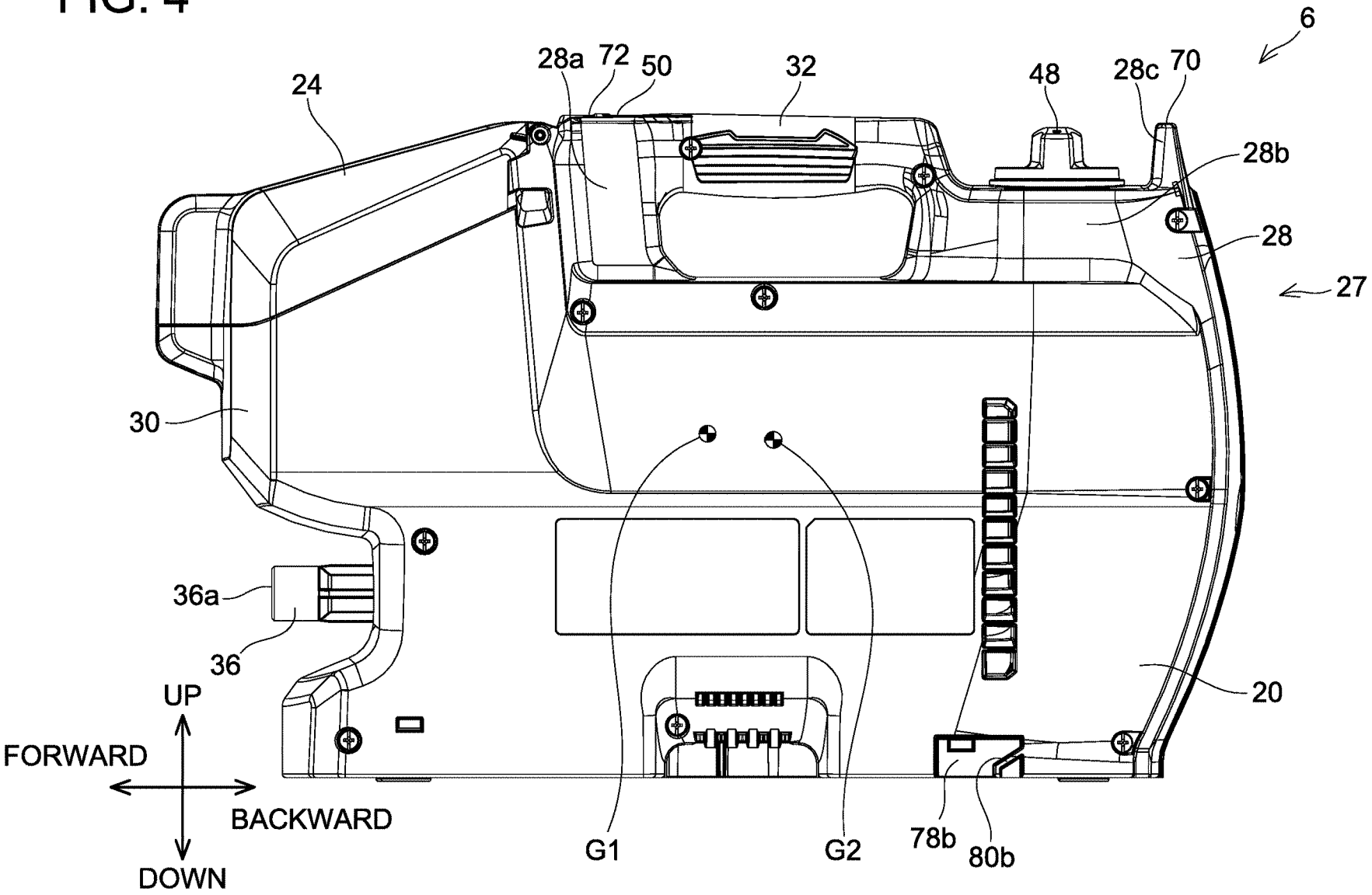
FIG. 4 is a side view seeing the washer body 6 according to the embodiment from a left side.
Figure 5:
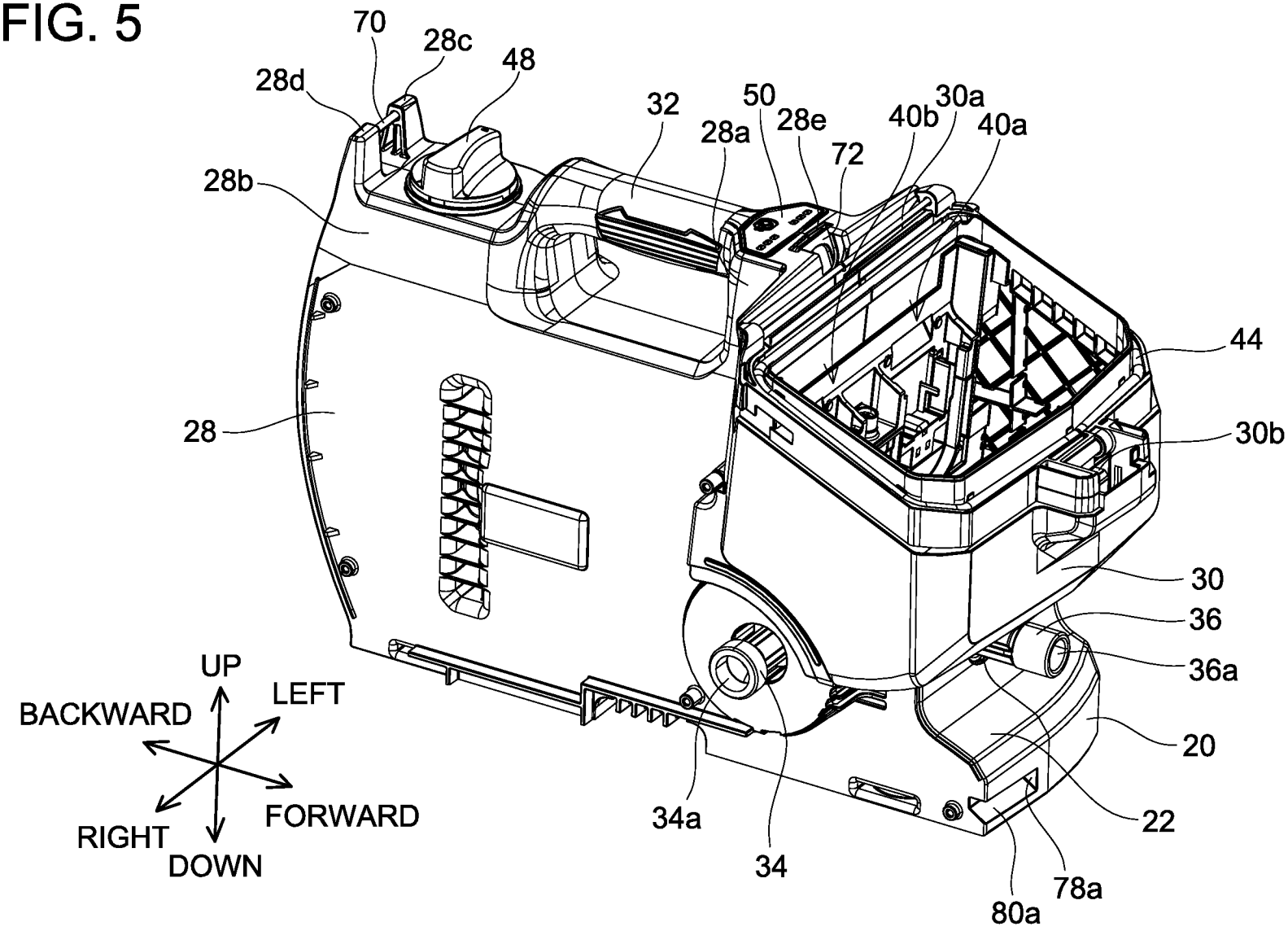
FIG. 5 is a perspective view seeing the washer body 6 according to the embodiment from the front-right upper side in a state of having detached a battery box cover 24 and an accessory box 26.

As shown in FIGS. 2 to 4, the washer body 6 includes a left-side housing 20, a right-side housing 22, a battery box cover 24, and an accessory box 26. Hereafter, the left-side housing 20, the right-side housing 22, the battery box cover 24, and the accessory box 26 may collectively be termed a housing 27. As shown in FIG. 5, a main housing 28, a battery box 30, and a top handle 32 are constituted by the left-side housing 20 and the right-side housing 22. The left-side housing 20 defines outer shapes of left-half surfaces of the main housing 28, the battery box 30, and the top handle 32, and the right-side housing 22 defines outer shapes of right-half surfaces of the main housing 28, the battery box 30, and the top handle 32.

The main housing 28 has a substantially rectangular shape which is larger in an up-down direction than in a left-right direction and is larger in a front-rear direction than in the up-down direction. An inlet joint 34 projecting rightward is provided at a front-lower side of a right surface of the main housing 28. The inlet joint 34 protrudes outward from inside of the main housing 28, and is configured to detachably receive the self-supply hose 10 (see FIG. 1) and the pressure-resistant hose 14 (see FIG. 15). The inlet joint 34 includes a water inlet **34*a* into which water flows. An outlet joint 36 protruding frontward is provided at a lower part of a front surface of the main housing 28. The outlet joint 36 protrudes outward from inside of the main housing 28, and is configured to detachably receive the pressurizing hose 12 (see FIG. 1). The outlet joint 36 includes a water outlet 36*a*** from which water flows out.

Figure 6:
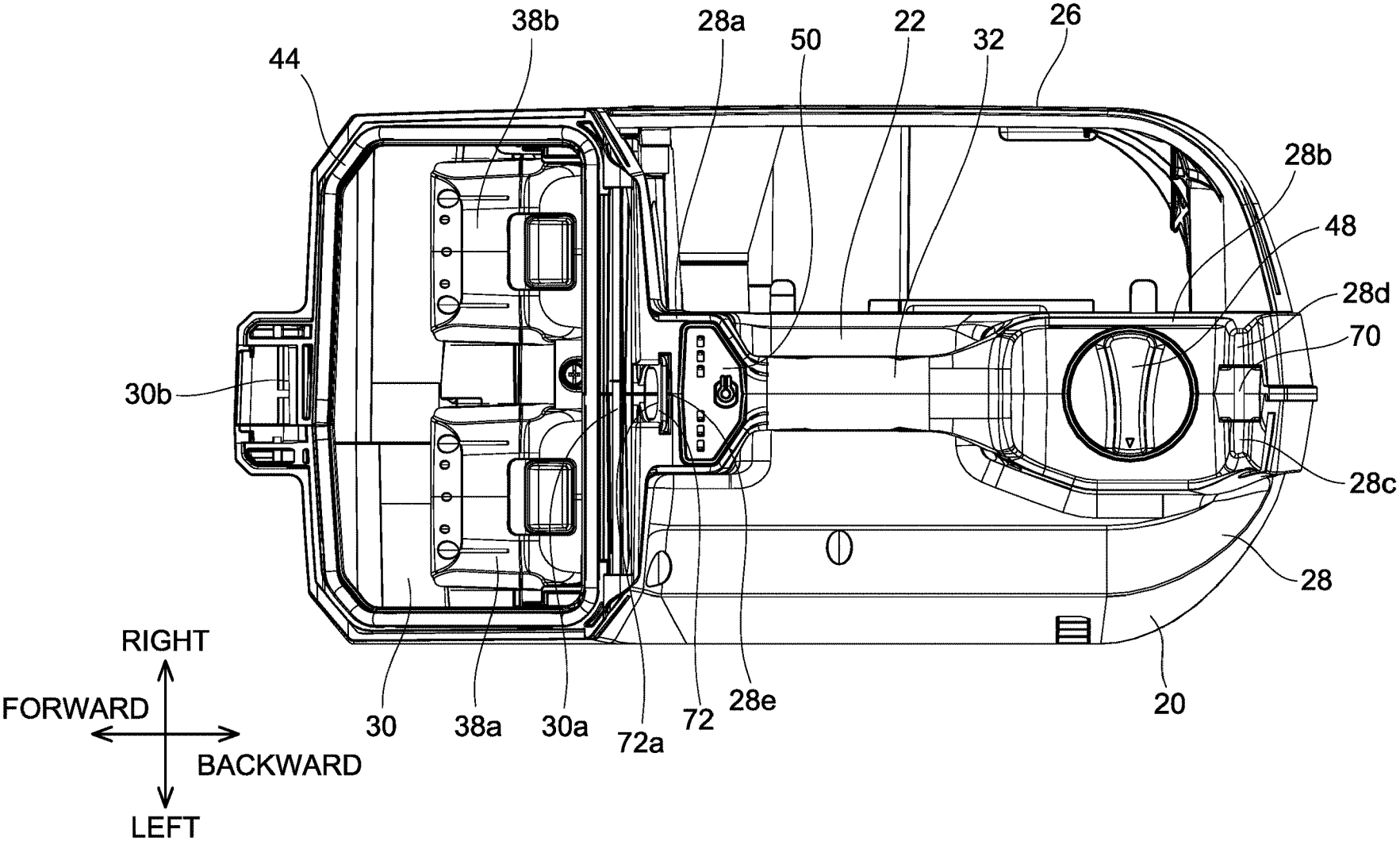
FIG. 6 is a plan view seeing the washer body 6 according to the embodiment from the upper side in a state of having detached the battery box cover 24.
Figure 7:
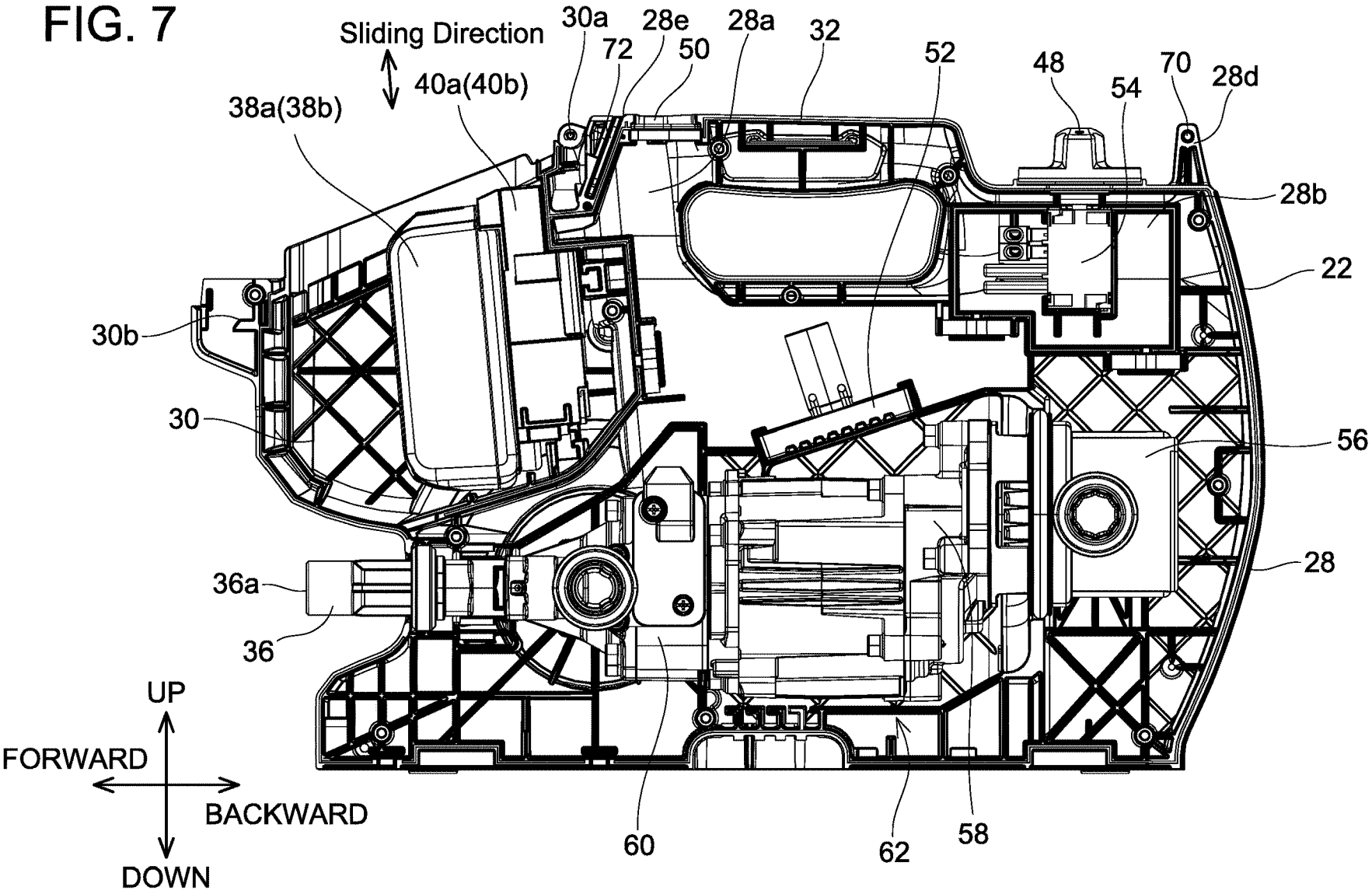
FIG. 7 is a side view seeing the washer body 6 according to the embodiment from the left side in a state of having detached the battery box cover 24 and a left-side housing 20.

The battery box 30 is provided on a front-upper side of the main housing 28. The battery box 30 has a box shape having an opening oriented toward a front-upper side. The battery box 30 has its left-side outer surface substantially flush with the left-side outer surface of the main housing 28, and its right-side outer surface protruding right-ward than the right-side outer surface of the main housing 28. As shown in FIGS. 6 and 7, the battery box 30 includes therein a battery receptacle 40*a* configured to detachably receive a battery 38*a* and a battery receptacle 40*b* configured to detachably receive a battery 38*b*. As shown in FIG. 6, in a state where the batteries 38*a*, 38*b* are attached to the battery receptacles 40*a*, 40*b*, the batteries 38*a*, 38*b* are arranged side by side in the left-right direction. Both of the batteries 38*a*, 38*b* are secondary batteries such as lithium ion batteries. Each of the batteries 38*a*, 38*b* is configured to be charged by a charger 39 (see FIG. 8). Each of the batteries 38*a*, 38*b* has a rated voltage of 18V, for example. The batteries 38*a*, 38*b* are configured to be attached/detached to and from the battery receptacles 40*a*, 40*b* by sliding in a predetermined direction with respect to the battery receptacles 40*a*, 40*b*. In a state where the batteries 38*a*, 38*b* are attached to the battery receptacles 40*a*, 40*b*, the batteries 38*a*, 38*b* are electrically connected in series, by which power of a total voltage (e.g. 36V) of the rated voltages (e.g. 18V) of the batteries 38*a*, 38*b* is supplied to the washer body 6.

Figure 8:
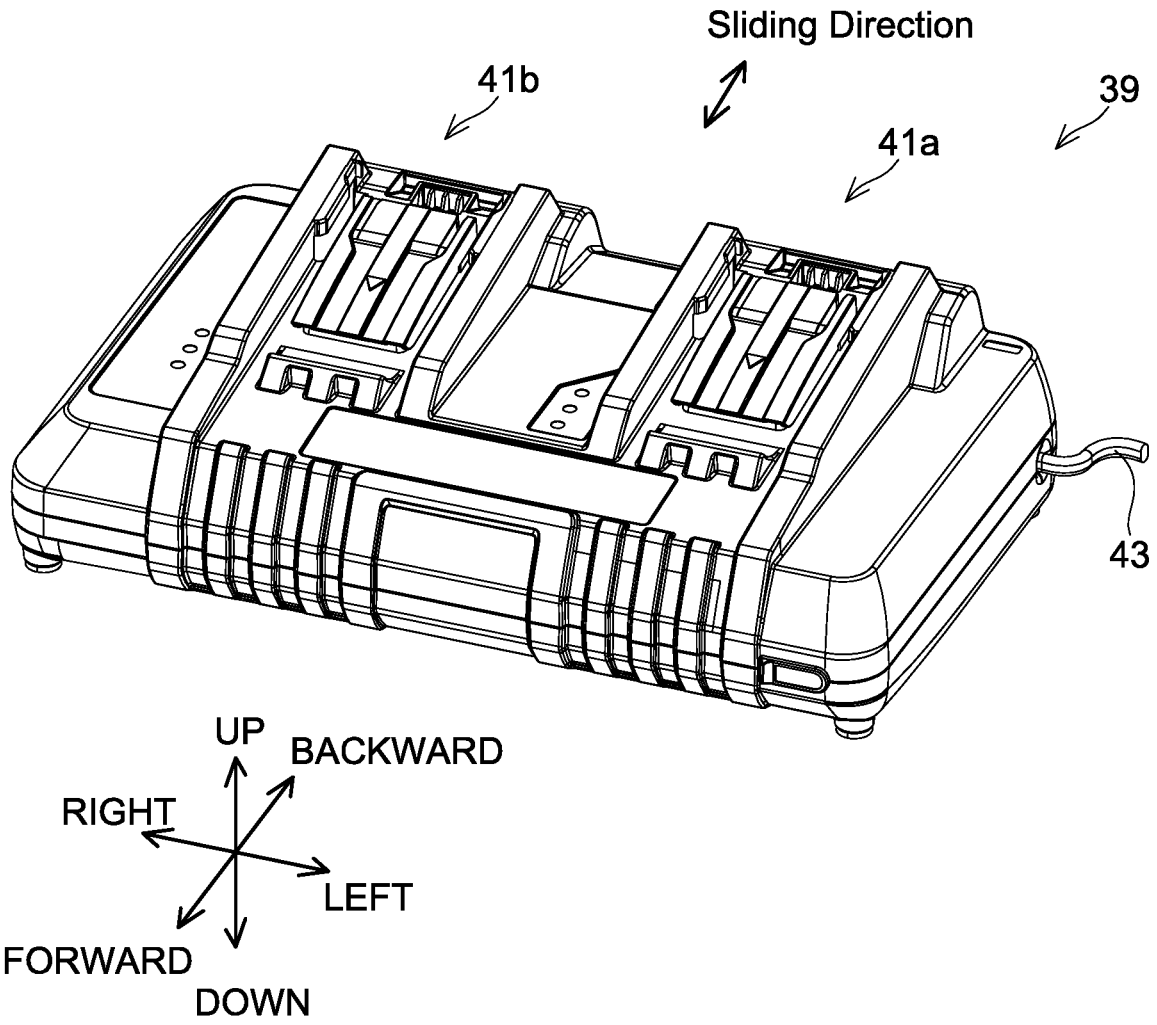
FIG. 8 is a perspective view seeing a charger 39 according to the embodiment.

As shown in FIG. 8, the charger 39 comprises battery receptacles 41*a*, 41*b* configured to detachably receive the batteries 38*a*, 38*b*, and a power cable 43 connectable with AC power supply. The batteries 38*a*, 38*b* are configured to be detachably attached to the battery receptacles 41*a*, 41*b* by sliding with respect to the battery receptacles 41*a*, 41*b*. The charger 39 is configured to convert AC power supplied from the power cable 43 to DC power so as to charge the batteries 38*a*, 38*b* attached to the battery receptacles 41*a*, 41*b*.

As shown in FIGS. 2 to 4, the battery box cover 24 is provided on an upper side of the battery box 30. The battery box cover 24 is rotatably connected to the battery box 30 about a rotation shaft 30*a* (see FIGS. 5 and 6). The rotation shaft 30*a* is located on a rear upper side of the battery box 30, and has its longitudinal direction in the left-right direction. The battery box cover 24 is biased to a closing direction by a torsion spring not shown. A latch 42 is provided at a distal end of the battery box cover 24. As shown in FIGS. 5 and 6, a latch receiver 30*b* is provided at the front-upper side of the battery box 30. The battery box cover 24 is maintained in a closed state by operating the latch 42 to engage with the latch receiver 30*b* in a state where the battery box cover 24 is closed. The battery box cover 24 is brought into an opened state by operating the latch 42 to be released from the engagement with the latch receiver 30*b* and pressing the distal end of the battery box cover 24 upward against biasing force of the torsion spring. As shown in FIG. 6, a sealer 44 constituted of resin is provided at a periphery of the opening of the battery box 30.

As shown in FIGS. 2 to 4, a front support 28*a* extending upward along a rear surface of the battery box 30 is provided on the front-upper side of the main housing 28, and a rear support 28*b* protruding upward is provided on a rear-upper side of the main body housing 28. The top handle 32 is provided so as to connect a rear-upper side of the front support 28*a* and a front-upper side of the rear support 28*b*. The top handle 32 has a substantially cylinder shape. The user can lift the washer body 6 up and carry the same by gripping the top handle 32. An adjustment dial 48 for adjusting a discharge amount of water from the outlet joint 36 is provided on an upper surface of the rear support 28*b*. An operation display panel 50 for displaying a state of the washer body 6 for the user to see and receiving operational inputs from the user is provided on an upper surface of the front support 28*a*.

Figure 9:
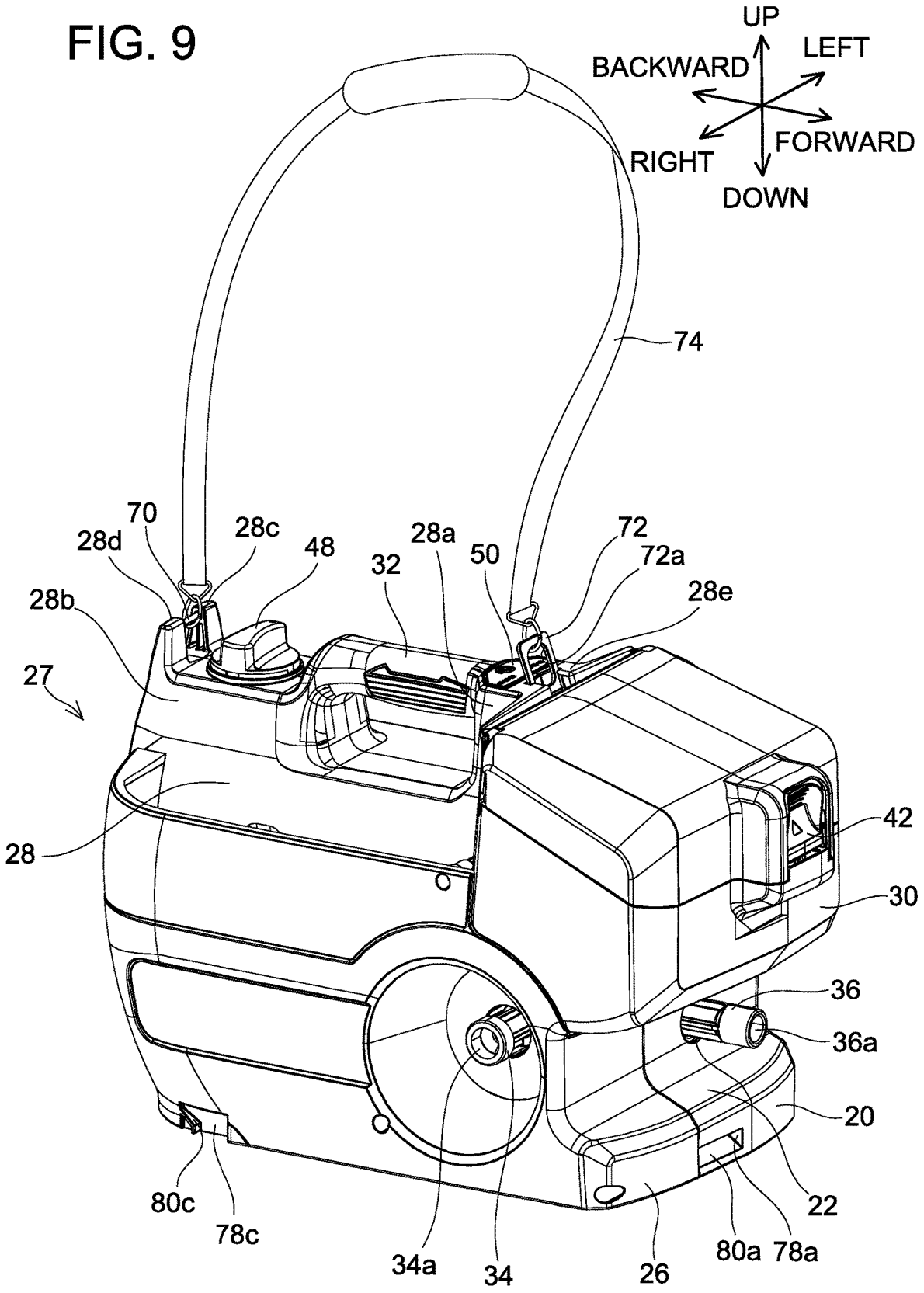
FIG. 9 is a perspective view seeing the washer body 6 according to the embodiment from the front-right upper side in a state of having attached a shoulder belt 74.

Support pillars 28*c*, 28*d* protruding upward are provided at a rear end of the upper surface of the rear support 28*b*. A support pin 70 having its longitudinal direction in the left-right direction is provided between the support pillars 28*c*, 28*d*. The support pin 70 has its left end fixed to a vicinity of an upper end of the support pillar 28*c* and its right end fixed to a vicinity of an upper end of the support pillar 28*d*. An accommodating groove 28*e* for accommodating a support plate 72 therein is provided at a front end of the upper surface of the front support 28*a*. The support plate 72 is supported by the front support 28*a* slidably between an accommodated position (see FIG. 2) at which an entirety of the support plate 72 is accommodated in the accommodating groove 28*e* and a pulled-out position (see FIG. 9) at which a part of the support plate 72 protrudes outside from the accommodating groove 28*e*. As shown in FIG. 9, the support plate 72 has a through hole 72*a* defined therein. A shoulder belt 74 can be attached to the washer body 6 by having one end of the shoulder belt 74 engaged with the support plate 72 and another end thereof engaged with the support pin 70 in a state of having slid the support plate 72 to the pulled-out position. The user can carry the washer body 6 in a state of having the shoulder belt 74 strapped over his/her shoulder in a state where the shoulder belt 74 is attached to the washer body 6. In a state of having detached the shoulder belt 74 from the washer body 6, by sliding the support plate 72 to the accommodated position (see FIG. 2), it is possible to prevent the battery box cover 24 from interfering with the support plate 72 when the battery box cover 24 is widely opened.

The accessory box 26 is attached to the right surface of the main housing 28. A right-side outer surface of the accessory box 26 is substantially flush with the right-side outer surface of the battery box 30. The accessory box 26 has a box shape an upper side of which is opened. Accessories such as the trigger gun 8, the jet nozzle 16, the self-supply hose 10, and the pressurizing hose 12 can be stored in the accessory box 26 when the pressure washer 2 is not in use. By lifting the washer body 6 up by gripping the top handle 32 in this state, or by lifting the washer body 6 up by strapping the shoulder belt 74 shown in FIG. 9 over his/her shoulder, the user can carry the washer body 6 together with the accessories.

The accessory box 26 has a shape recessed in a substantial truncated cone shape in a vicinity of the inlet joint 34. A tip of the inlet joint 34 does not protrude rightward than the outer surface of the accessory box 26. Thereby, even when the washer body 6 in a state of having the self-supply hose 10 or the pressure-resistant hose 14 not connected thereto falls down from a high place and the right surface of the washer body 6 collides with a ground, the tip of the inlet joint 34 can be prevented from colliding with the ground and being damaged.

The main housing 28 has a shape recessed in a substantial trapezoidal shape in a vicinity of the outlet joint 36. A tip of the outlet joint 36 does not protrude frontward than a plane in contact with both the outer surface of the battery box 30 and the outer surface of the main housing 28. Thereby, even when the washer body 6 in a state of having the pressurizing hose 12 not connected thereto falls from a high place and a front surface of the washer body 6 collides with the ground, the tip of the outlet joint 36 can be prevented from colliding with the ground and being damaged.

As shown in FIG. 7, an electronic control unit (ECU) 52, a dial detection switch 54, an electronic motor 56, a transmission mechanism 58, and a pump mechanism 60, etc. are accommodated in the main housing 28. The ECU 52 is disposed at an upper-side center of the inside of the main housing 28. The ECU 52 is above the pump mechanism 60 and below the top handle 32. In the state of having the batteries 38*a*, 38*b* attached to the battery receptacles 40*a*, 40*b*, the ECU 52 has its lower end positioned higher than lower ends of the batteries 38*a*, 38*b* and its upper end positioned lower than upper ends of the batteries 38*a*, 38*b*. The ECU 52 is configured to control operations of various types of electronical components installed in the washer body 6. The dial detection switch 54 is disposed inside the rear support 28*b* of the main housing 28. The dial detection switch 54 is configured to detect a rotation angle of the adjustment dial 48. The operation display panel 50 and the dial detection switch 54 are connected to the ECU 52 via wiring not shown. Further, the ECU 52 is connected to the battery receptacles 40*a*, 40*b* via wiring not shown. Further, the ECU 52 is connected to the electronic motor 56 via wiring not shown. The ECU 52 is configured to control the operation of the electronic motor 56 by controlling the power supplied from the batteries 38*a*, 38*b* to the electronic motor 56 based on a signal inputted to the operation display panel 50 and/or the dial detection switch 54.

Figure 10:
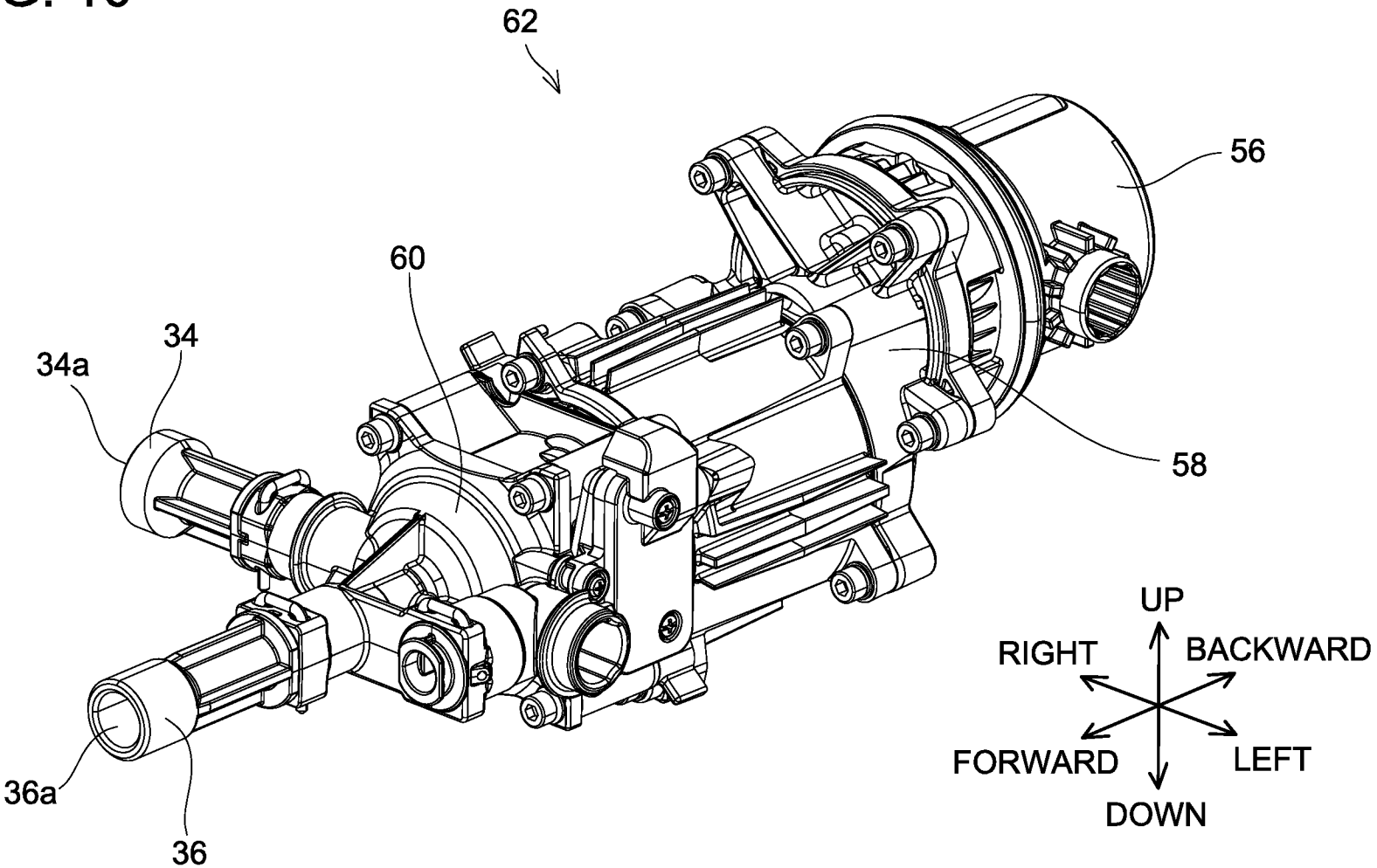
FIG. 10 is a perspective view seeing a motor pump unit 62 of the washer body 6 according to the embodiment from a front-left upper side.

As shown in FIG. 10, the electronic motor 56, the transmission mechanism 58, and the pump mechanism 60 are unitized as a motor pump unit 62. The electronic motor 56 is, for example, a brushless DC motor of an outer rotor type. The electronic motor 56 rotates so as to drive the pump mechanism 60 via the transmission mechanism 58. When the pump mechanism 60 is driven by the electronic motor 56, the pump mechanism 60 draws water in from the water inlet 34*a* and feeds out pressurized water from the water outlet 36*a*.

As shown in FIG. 3, in the pressure washer 2 of the present embodiment, in a plan view of the washer body 6 seen from above, a center of gravity G1 of the washer body 6 in the state of having the batteries 38*a*, 38*b* attached thereto is positioned within a range of 1.5 times a width W of the top handle 32 from a centerline of the top handle 32 in the left-right direction, preferably is positioned within a range of 1.0 times the width W of the top handle 32 from the centerline of the top handle 32 in the left-right direction, and more preferably is positioned within a range of 0.5 times the width W of the top handle 32 from the centerline of the top handle 32 in the left-right direction. Due to this, the washer body 6 in the state of having the batteries 38*a*, 38*b* attached thereto can be easily balanced in the left-right direction when the user lifts the washer body 6 up by gripping the top handle 32. Further, in the pressure washer 2 of the present embodiment, in the plan view of the washer body 6 seen from above, a center of gravity G2 of the washer body 6 in a state of having the batteries 38*a*, 38*b* detached therefrom is positioned within the range of 1.5 times the width W of the top handle 32 of from the centerline of the top handle 32 in the left-right direction, preferably is positioned within the range of 1.0 times the width W of the top handle 32 from the centerline of the top handle 32 in the left-right direction, and more preferably is positioned within the range of 0.5 times the width W of the top handle 32 from the centerline of the top handle 32 in the left-right direction. Due to this, the washer body 6 in the state of having the batteries 38*a*, 38*b* detached therefrom can be easily balanced in the left-right direction when the user lifts the washer body 6 up by gripping the top handle 32.

In the pressure washer 2 of the present embodiment, in the plan view of the washer body 6 seen from above, the center of gravity G1 of the washer body 6 in the state of having the batteries 38*a*, 38*b* attached thereto is positioned within a range of 1.5 times a dimension W2 of the support pin 70 from a centerline of the support pin 70 in the left-right direction, preferably is positioned within a range of 1.0 times the dimension W2 of the support pin 70 from the centerline of the support pin 70 in the left-right direction, and more preferably is positioned within a range of 0.5 times the dimension W2 of the support pin 70 from the centerline of the support pin 70 in the left-right direction. In the pressure washer 2 of the present embodiment, in the plan view of the washer body 6 seen from above, the center of gravity G1 of the washer body 6 in the state of having the batteries 38*a*, 38*b* attached thereto is positioned within a range of 1.5 times a dimension W3 of the through hole 72*a* of the support plate 72 from a centerline of the support plate 72 in the left-right direction, preferably is positioned within a range of 1.0 times the dimension W3 of the through hole 72*a* of the support plate 72 from the centerline of the support plate 72 in the left-right direction, and more preferably is positioned within a range of 0.5 times the dimension W3 of the through hole 72*a* of the support plate 72 from the centerline of the support plate 72 in the left-right direction. Due to this, when the user uses the shoulder belt 74 to sling the washer body 6 in the state of having the batteries 38*a*, 38*b* attached thereto over his/her shoulder, the washer body 6 can be easily balanced in the left-right direction. Further, in the pressure washer 2 of the present embodiment, in the plan view of the washer body 6 seen from above, the center of gravity G2 of the washer body 6 in the state of having the batteries 38*a*, 38*b* detached therefrom is positioned within the range of 1.5 times the dimension W2 of the support pin 70 from the centerline of the support pin 70 in the left-right direction, preferably is positioned within the range of 1.0 times the dimension W2 of the support pin 70 from the centerline of the support pin 70 in the left-right direction, and more preferably is positioned within the range of 0.5 times the dimension W2 of the support pin 70 from the centerline of the support pin 70 in the left-right direction. Further, in the pressure washer 2 of the present embodiment, in the plan view of the washer body 6 seen from above, the center of gravity G2 of the washer body 6 in the state of having the batteries 38*a*, 38*b* detached therefrom is positioned within the range of 1.5 times the dimension W3 of the through hole 72*a* of the support plate 72 from the centerline of the support plate 72 in the left-right direction, preferably is positioned within the range of 1.0 times the dimension W3 of the through hole 72*a* of the support plate 72 from the centerline of the support plate 72 in the left-right direction, and more preferably is positioned within the range of 0.5 times the dimension W3 of the through hole 72*a* of the support plate 72 from the centerline of the support plate 72 in the left-right direction. Due to this, when the user uses the shoulder belt 74 to sling the washer body 6 in the state of having the batteries 38*a*, 38*b* detached therefrom, the washer body 6 can be easily balanced in the left-right direction.

As shown in FIG. 4, in the pressure washer 2 of the present embodiment, in a plan view of the washer body 6 seen from a left side, the center of gravity G1 of the washer body 6 in the state of having the batteries 38*a*, 38*b* attached thereto is positioned within a range from a front end to a rear end of a lower surface of the top handle 32 in the front-rear direction. Due to this, when the user lifts the pressure washer 2 in the state of having the batteries 38*a*, 38*b* attached thereto by gripping the top handle 32, the washer body 6 can be easily balanced in the front-rear direction. Further, in the pressure washer 2 of the present embodiment, in the plan view of the washer body 6 seen from the left side, the center of gravity G2 of the washer body 6 in the state of having the batteries 38*a*, 38*b* detached therefrom is positioned within the range from the front end to the rear end of the lower surface of the top handle 32 in the front-rear direction. Due to this, when the user lifts the washer body 6 in the state of having the batteries 38*a*, 38*b* detached therefrom by gripping the top handle 32, the washer body 6 can be easily balanced in the front-rear direction.

In the pressure washer 2 of the present embodiment, in the plan view of the washer body 6 seen from the left side, the center of gravity G1 of the washer body 6 in the state of having the batteries 38*a*, 38*b* attached thereto is positioned within a range from a rear surface of the front support 28*a* to a front surface of the rear support 28*b* in the front-rear direction. Due to this, when the user uses the shoulder belt 74 to sling the washer body 6 in the state of having the batteries 38*a*, 38*b* attached thereto over his/her shoulder, the washer body 6 can be easily balanced in the front-rear direction. Further, in the pressure washer 2 of the present embodiment, in the plan view of the washer body 6 seen from the left side, the center of gravity G2 of the washer body 6 in the state of having the batteries 38*a*, 38*b* detached therefrom is positioned within the range from the rear surface of the front support 28*a* to the front surface of the rear support 28*b* in the front-rear direction. Due to this, when the user uses the shoulder belt 74 to sling the washer body 6 in the state of having the batteries 38*a*, 38*b* detached therefrom over his/her shoulder, the washer body 6 can be easily balanced in the front-rear direction.

Figure 11:
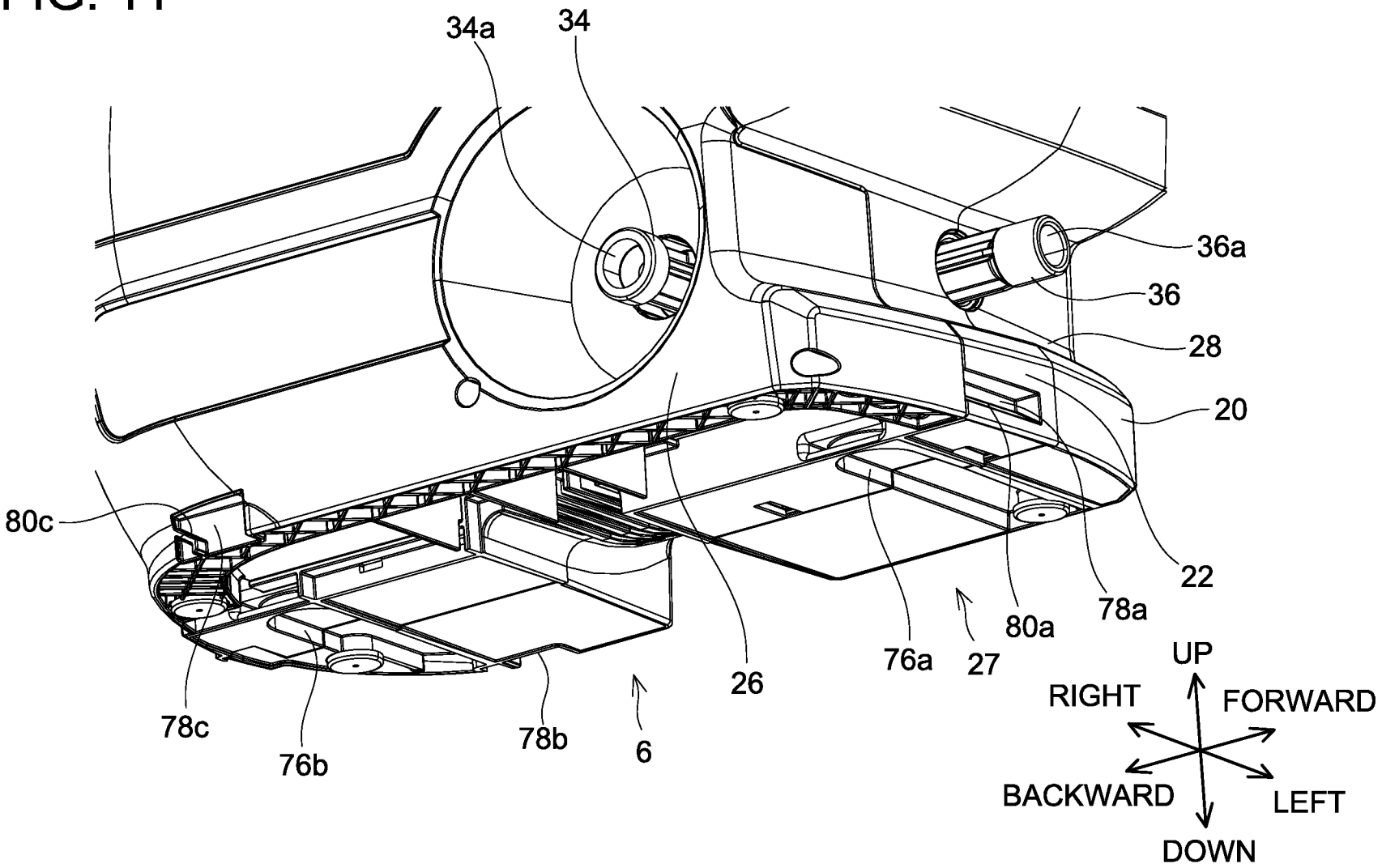
FIG. 11 is a perspective view seeing the washer body 6 according to the embodiment from a front-right lower side.

As shown in FIG. 11, positioning grooves 76*a*, 76*b* are provided on a lower surface of the main housing 28. Further, an engaging groove 78*a* is provided in a vicinity of a lower end of the front surface of the main housing 28, more specifically in a vicinity of a lower end of a front surface of the right-side housing 22. An engaging groove 78*b* is provided in a vicinity of a rear-lower end of a left-side surface of the main housing 28, more specifically in a vicinity of a rear-lower end of a left-side surface of the left-side housing 20. An engaging groove 78*c* is provided in a vicinity of a rear-lower end of a right-side surface of the accessory box 26. The engaging groove 78*a* includes therein an engaging wall 80*a* an upper side of which is angled rearward relative to the up-down direction. The engaging groove 78*b* includes therein an engaging wall 80*b* (see FIG. 4) an upper side of which is angled rearward relative to the up-down direction. The engaging groove 78*c* includes therein an engaging wall 80*c* an upper side of which is angled rearward relative to the up-down direction.

Figure 12:
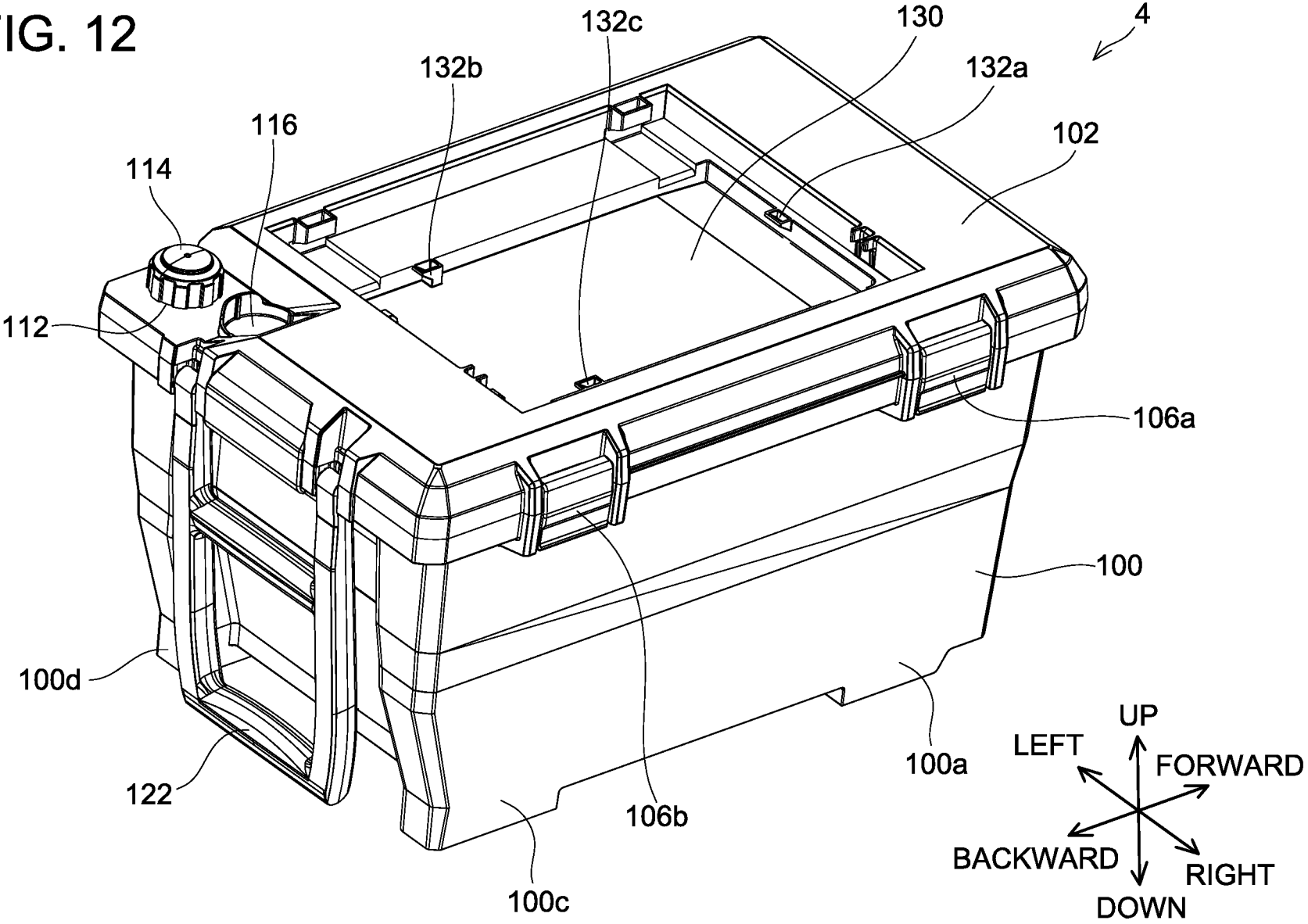
FIG. 12 is a perspective view seeing an accommodation case 4 according to the embodiment from a rear-right upper side.
Figure 13:
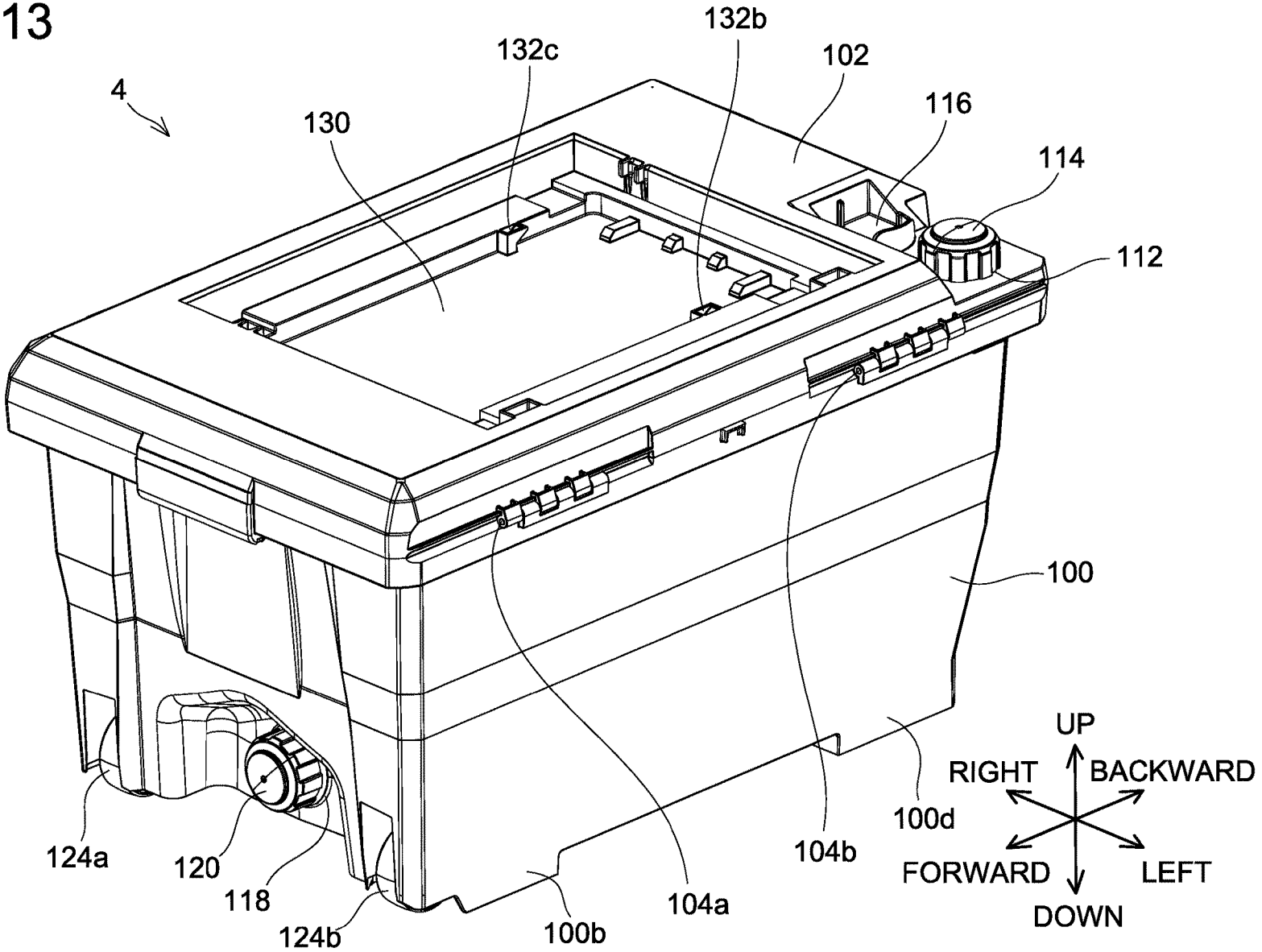
FIG. 13 is a perspective view seeing the accommodation case 4 according to the embodiment from the front-left upper side.
Figure 14:
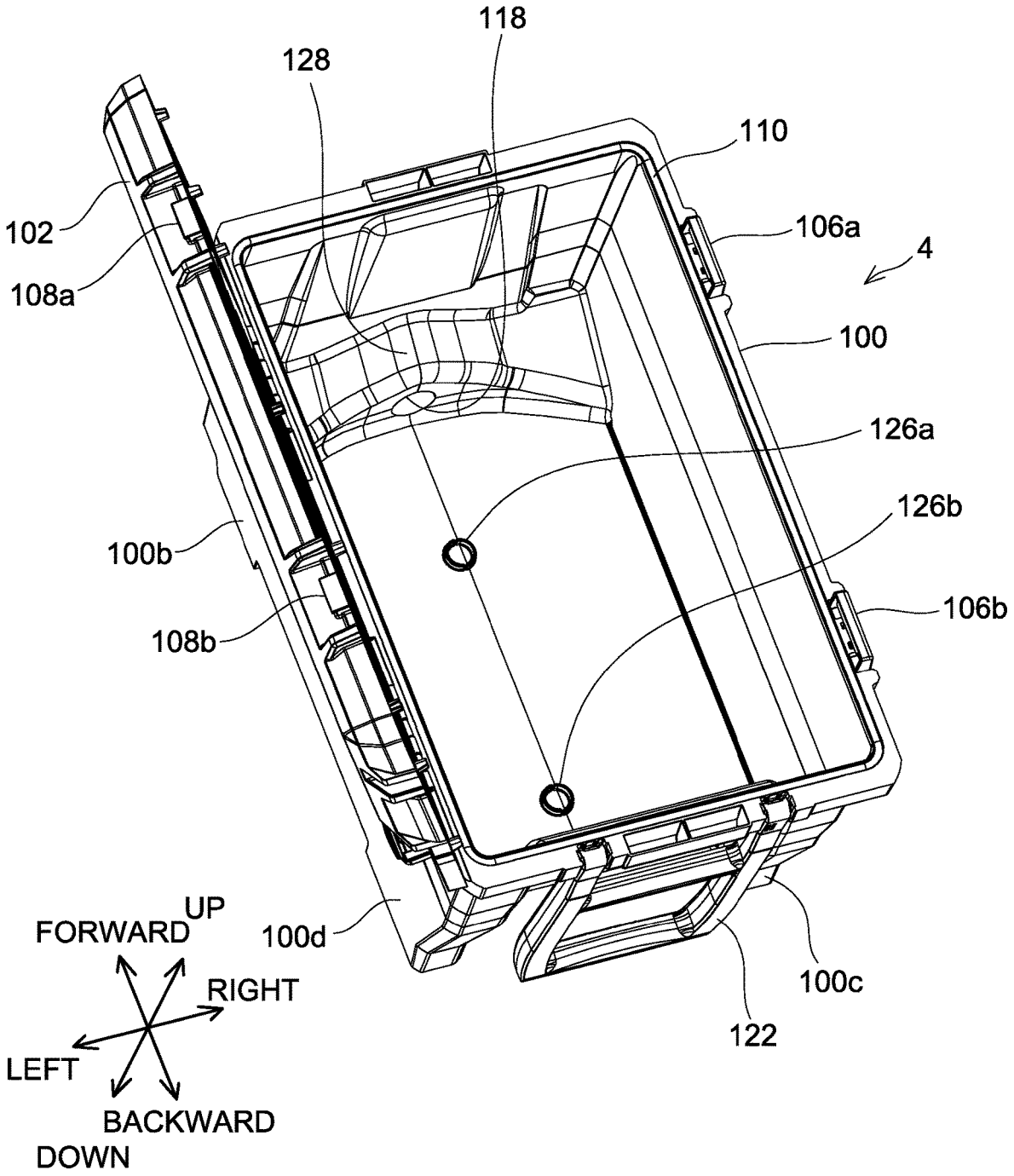
FIG. 14 is a perspective view seeing the accommodation case 4 according to the embodiment from a rear-left upper side in a state of having opened a case cover 102.

As shown in FIGS. 12 and 13, the accommodation case 4 includes a case body 100 and a case cover 102. The case body 100 has a box shape a top of which is opened. The case body 100 has a water capacity of 50 liters, for example. Feet 100*a*, 100*b*, 100*c*, 100*d* are provided on a lower surface of the case body 100. When the case body 100 is placed on the ground, the feet 100*a*, 100*b*, 100*c*, 100*d* contact the ground. The case cover 102 is rotatably connected to the case body 100 about hinge pins 104*a*, 104*b*. The hinge pins 104*a*, 104*b* are arranged collinearly, and have their longitudinal directions in the front-rear direction. The hinge pins 104*a*, 104*b* connect a leftward upper end of the case body 100 and a leftward lower end of the case cover 102 with each other. Latches 106*a*, 106*b* are provided at a rightward upper end of the case body 100. As shown in FIG. 14, latch receivers 108*a*, 108*b* are provided at a tip of the case cover 102. By operating the latches 106*a*, 106*b* to be engaged with the latch receivers 108*a*, 108*b* in a state where the case cover 102 is closed, the case cover 102 is maintained in the closed state. Starting from this state, when the latches 106*a*, 106*b* are operated to release their engagement with the latch receivers 108*a*, 108*b*, and the tip of the case cover 102 is pressed upward, the case cover 102 is brought into an open state. A sealer 100 constituted of resin is provided at a periphery of the opening of the case body 100.

As shown in FIG. 12, a water-feeding port 112 is provided at a left-rear side of the case cover 102. A cap 114 is attached to the water-feeding port 112. In a state where the case cover 102 is closed and also the cap 114 is detached, water from the water supply system can be delivered into the accommodation case 4 through the water-feeding port 112. Further, in the state where the case cover 102 is closed and also the cap 114 is detached, water can be supplied from the accommodation case 4 to the washer body 6 by connecting the self-supply hose 10 to the water-feeding port 112. A cap receptacle 116, on which the detached cap 114 can be placed, is arranged in a vicinity of the water-feeding port 112 of the case cover 102.

As shown in FIG. 13, a drain port 118 is provided at a rear-lower side of the case body 100. A cap 120 is attached to the drain port 118. In a state where the cap 120 is detached, water inside the accommodation case 4 can be drained to the outside through the drain port 118. The cap 120 has a same shape as the cap 114, thus the detached cap 120 can be placed on the cap receptacle 116.

As shown in FIG. 12, a handle 122 is provided at a rear-upper side of the case body 100. The handle 122 is rotatably attached to the case body 100 about a rotation shaft extending in the left-right direction. While the accommodation case 4 is placed on the ground, by having the handle 122 rotated downward, the handle 122 can be prevented from interfering with opening/closing operations of the case cover 102, a water-feeding operation from the water supply system to the accommodation case 4 through the water-feeding port 112, and a water-feeding operation from the accommodation case 4 to the washer body 6 through the water-feeding port 112. When the accommodation case 4 is transported, by having the handle 122 rotated upward, the user can carry the accommodation case 4 by gripping the handle 122.

As shown in FIG. 13, wheels 124*a*, 124*b* are provided in vicinities of left and right ends of a front-lower part of the case body 100. The wheels 124*a*, 124*b* are rotatably attached to the case body 100 about a rotation axis extending in the left-right direction. While the accommodation case 4 is placed on the ground, the wheels 124*a*, 124*b* are not in contact with the ground because the wheels 124*a*, 124*b* are located higher than lower surfaces of the feet 100*a*, 100*b*, 100*c*, 100*d*. When the user grips the handle 122 and tilts the accommodation case 4 so as to lift the rear side of the accommodation case 4 upward, the feet 100*a*, 100*b*, 100*c*, 100*d* separate away from the ground, and the wheels 124*a*, 124*b* come into contact with the ground. Due to this, the user can easily carry the accommodation case 4 by taking advantage of rotations of the wheels 124*a*, 124*b* in the state of gripping the handle 122.

As shown in FIG. 14, positioning protrusions 126*a*, 126*b* are provided on an inner bottom surface of the case body 100. The positioning protrusions 126*a*, 126*b* are used when the washer body 6 is to be accommodated in the case body 100. As shown in FIG. 15, when the washer body 6 is to be accommodated inside the accommodation case 4, the washer body 6 is placed on the bottom surface of the case body 100 such that a front side of the washer body 6 is positioned at a rear side of the accommodation case 4, and a rear side of the washer body 6 is positioned at a front side of the accommodation case 4. In doing so, the positioning protrusion 126*a* of the case body 100 enters into the positioning groove 76*b* (see FIG. 11) of the washer body 6, and the positioning protrusion 126*b* of the case body 100 enters into the positioning groove 76*a* (see FIG. 11) of the washer body 6. Due to this, in a state of having the washer body 6 accommodated in the accommodation case 4, the washer body 6 can be prevented from being displaced relative to the accommodation case 4 when the user grips the handle 122 to tilt the accommodation case 4 relative to the front-rear direction.

An inner wall surface of the case body 100 has a shape that interferes with the main housing 28 and the accessory box 26 of the washer body 6 if the washer body 6 is placed on the bottom surface of the case body 100 in an opposite direction, i.e., if the washer body 6 is placed on the bottom surface of the case body 100 in a state where the positioning protrusion 126*a* of the case body 100 is aligned with the positioning groove 76*a* of the washer body 6 and the positioning protrusion 126*b* of the case body 100 is aligned with the positioning groove 76*b* of the washer body 6. Due to this, it is possible to prevent the user from mistakenly placing the washer body 6 in the opposite direction on the bottom surface of the case body 100.

FIGS. 15 and 16 show states where the washer body 6, the trigger gun 8, the jet nozzle 16, the spray lance 17, the washing brush 18, the nozzle 19 with the detergent tank, the charger 39, the self-supply hose 10, the pressurizing hose 12, and the pressure-resistant hose 14 are accommodated within the accommodation case 4. The batteries 38*a*, 38*b* are accommodated within the accommodation case 4 together with the washer body 6 in the state of being attached to the battery receptacles 40*a*, 40*b* of the battery box 30 of the washer body 6. In FIG. 16, the illustration of the self-supply hose 10, the pressurizing hose 12, and the pressure-resistant hose 14 is omitted. Further, a front-rear direction, an up-down direction, and a left-right direction in FIGS. 15 and 16 indicate a front-rear direction, an up-down direction, and a left-right direction of the accommodation case 4, and those in FIGS. 15 and 16 differ from a front-rear direction, an up-down direction, and a left-right direction of the washer body 6. As shown in FIG. 16, the trigger gun 8, the jet nozzle 16, the spray lance 17, the washing brush 18, and the nozzle 19 with the detergent tank are accommodated in a space to the right from the washer body 6 within the accommodation case 4. The charger 39 is accommodated in a space to the front from the washer body 6 within the accommodation case 4. As shown in FIG. 15, the self-supply hose 10 and the pressure-resistant hose 14 are accommodated in a space to the left from the washer body 6 within the accommodation case 4. The pressurizing hose 12 is accommodated in a space between the washer body 6 and the charger 39 within the accommodation case 4.

Figure 17:
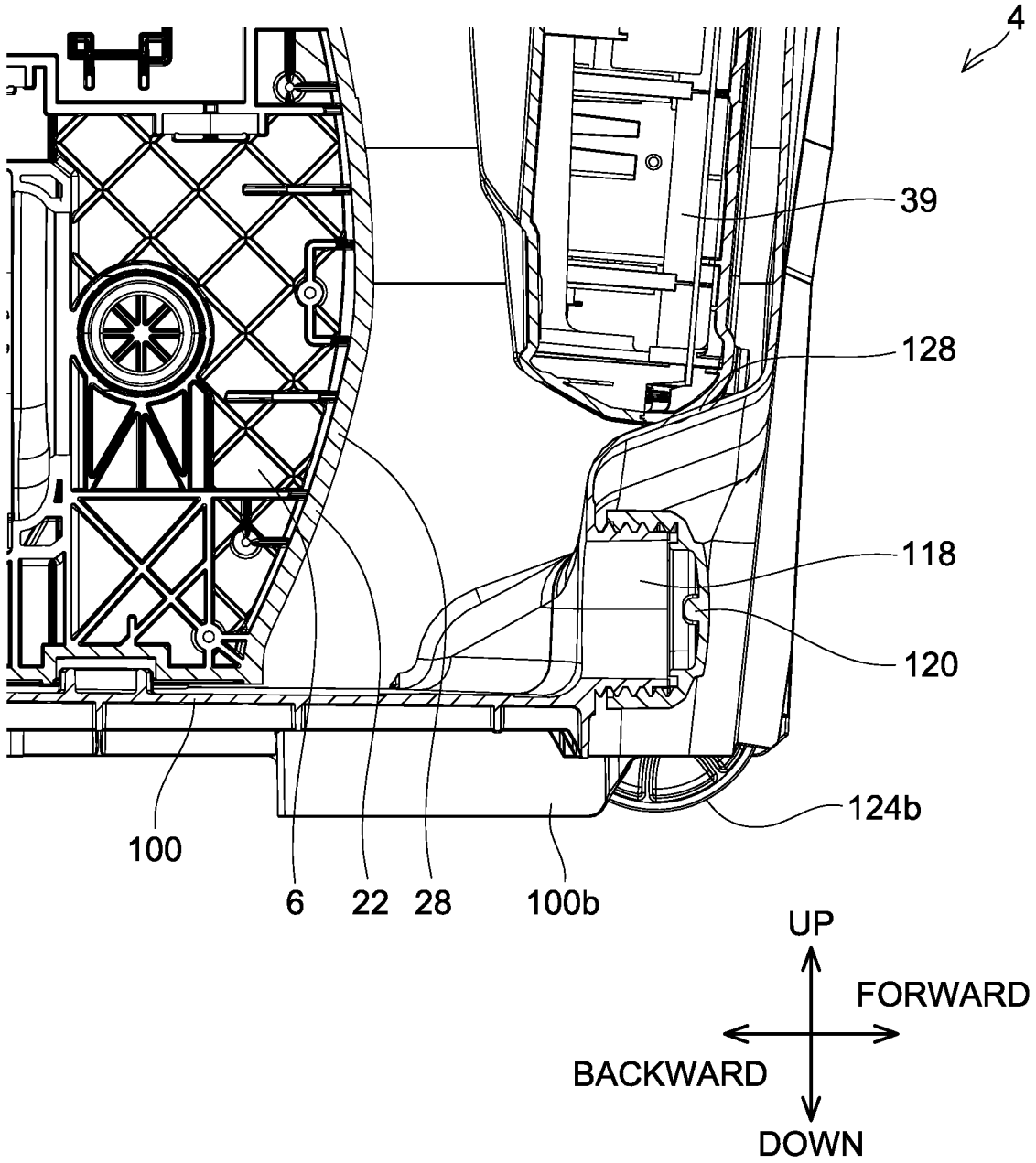
FIG. 17 is a vertical cross-sectional view of the pressure washer 2 according to the embodiment seeing a vicinity of a drain port 118 of the accommodation case 4 in a state of having the washer body 6, the trigger gun 8, and the various accessories accommodated within the accommodation case 4.

As shown in FIG. 14, a support wall 128, which is configured capable of supporting the charger 39 at a position higher than the drain port 118, is provided at a front side of an inner wall surface of the case body 100. Due to this, as shown in FIG. 17, the charger 39 is supported by the support wall 128 so as to be arranged at the higher position than the drain port 118 in the state where the washer body 6 and the charger 39 are accommodated within the accommodation case 4. According to such an arrangement, the charger 39 can be prevented from being splashed with water even when the water remains on the bottom surface of the accommodation case 4. Further, the batteries 38*a*, 38*b* of the washer body 6 are arranged at a higher position than the drain port 118 when the washer body 6 is placed on the bottom surface of the case body 100. Due to this, the batteries 38*a*, 38*b* can be prevented from being splashed with water even when the water remains on the bottom surface of the accommodation case 4.

As shown in FIG. 12, a placement groove 130 on which the washer body 6 is to be placed is provided on an upper surface of the case cover 102. Upon placing the washer body 6 on the upper surface of the accommodation case 4, the washer body 6 is placed in the placement groove 130 of the case cover 102 such that the front side of the washer body 6 is positioned on the front side of the accommodation case 4 and the rear side of the washer body 6 is positioned on the rear side of the accommodation case 4. An engaging pawl 132*a* that enters into the engaging groove 78*a* of the washer body 6 is provided on a front wall surface of the placement groove 130. An engaging pawl 132*b* that enters into the engaging groove 78*b* of the washer body 6 is provided on a rear-left side wall surface of the placement groove 130. An engaging pawl 132*c* that enters into the engaging groove 78*c* of the washer body 6 is provided on a rear-right side wall surface of the placement groove 130.

Figure 18:
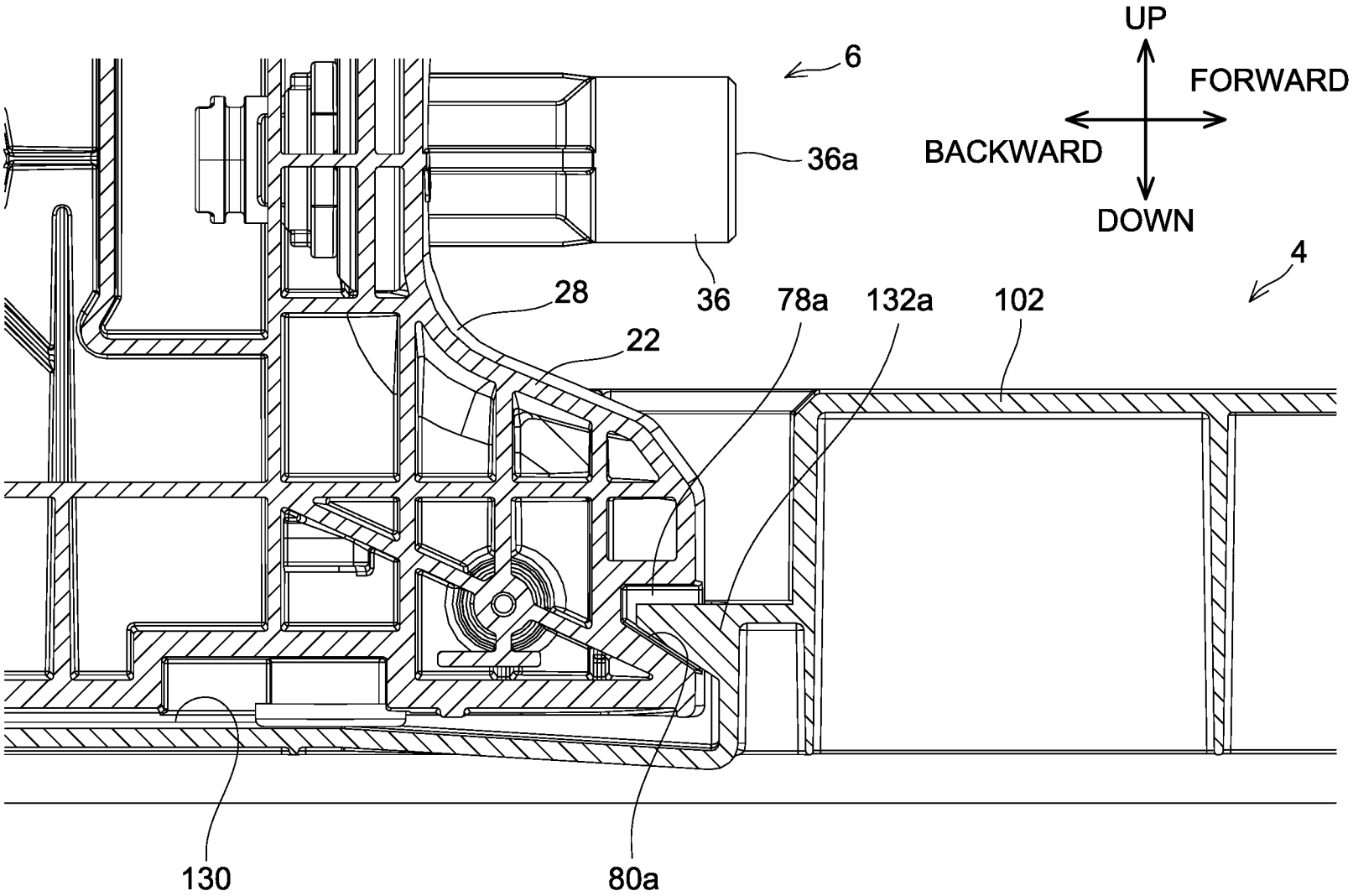
FIG. 18 is a vertical cross-sectional view of the pressure washer 2 according to the embodiment seeing a vicinity of an engaging groove 78*a* and an engaging pawl 132*a* in a state where the washer body 6 is mounted on the accommodation case 4 and the accommodation case 4 is placed on a ground.
Figure 19:
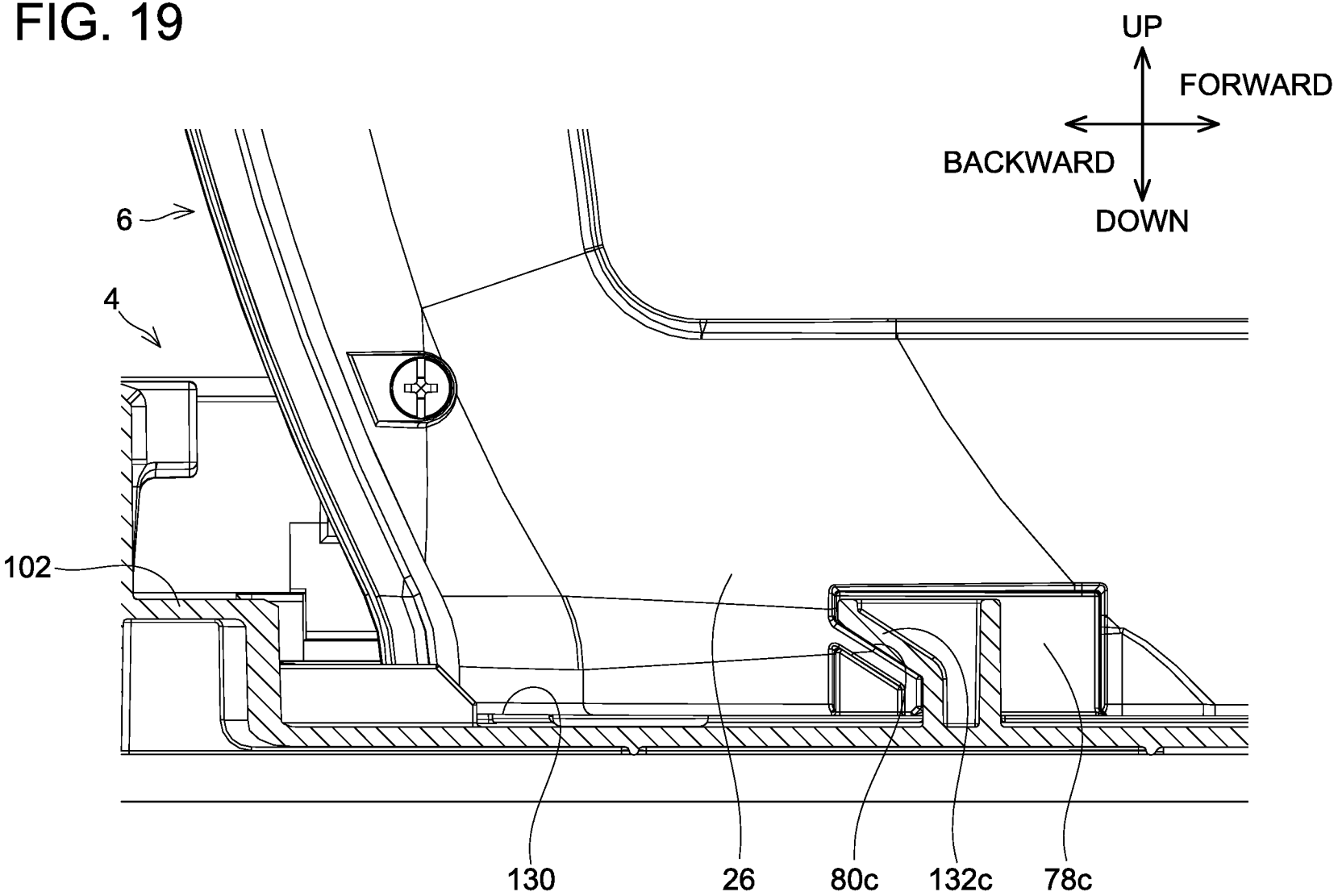
FIG. 19 is a vertical cross-sectional view of the pressure washer 2 according to the embodiment seeing a vicinity of an engaging groove 78*c* and an engaging pawl 132*c* in a state where the washer body 6 is mounted on the accommodation case 4 and the accommodation case 4 is placed on the ground.

As shown in FIGS. 18 and 19, upon placing the washer body 6 on the upper surface of the accommodation case 4 placed on the ground, the washer body 6 is moved downward from above with respect to the accommodation case 4 so as to let the engaging pawls 132*b*, 132*c* enter into the engaging grooves 78*b*, 78*c*. Starting from that state and moving the washer body 6 frontward with respect to the accommodation case 4, the engaging pawl 132*a* enters into the engaging groove 78*a* so that the engaging pawl 132*a* and the engaging wall 80*a* are engaged, the engaging pawl 132*b* is engaged with the engaging wall 80*b*, and the engaging pawl 132*c* is engaged with the engaging wall 80*c*, by which the washer body 6 is mounted on the upper surface of the accommodation case 4. Contrary to this, upon detaching the washer body 6 from the upper surface of the accommodation case 4 placed on the ground, the washer body 6 is moved rearward with respect to the accommodation case 4, by which the engaging pawl 132*a* is separated from the engaging wall 80*a* and released from the engaging groove 78*a*, the engaging pawl 132*b* is separated from the engaging wall 80*b*, and the engaging pawl 132*c* is separated from the engaging wall 80*c*. Starting from that state and moving the washer body 6 upward with respect to the accommodation case 4, the engaging pawls 132*b*, 132*c* are released from the engaging grooves 78*b*, 78*c*, by which the washer body 6 is detached from the upper surface of the accommodation case 4.

Figure 20:
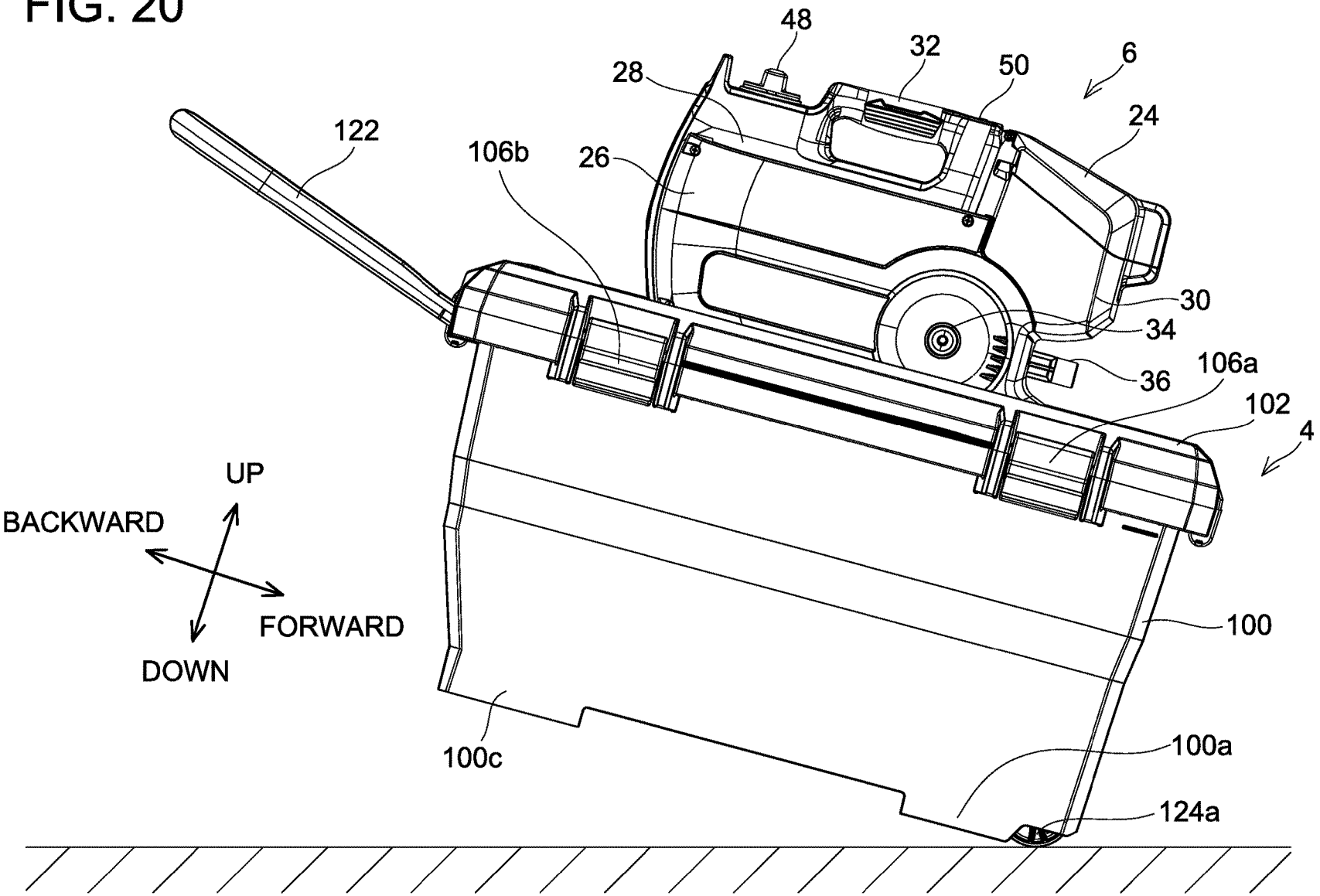
FIG. 20 is a right-side view of the pressure washer 2 according to the embodiment seeing a state where a user is gripping a handle 122 and carrying the accommodation case 4 under a state where the washer body 6 is mounted on the accommodation case 4.
Figure 21:
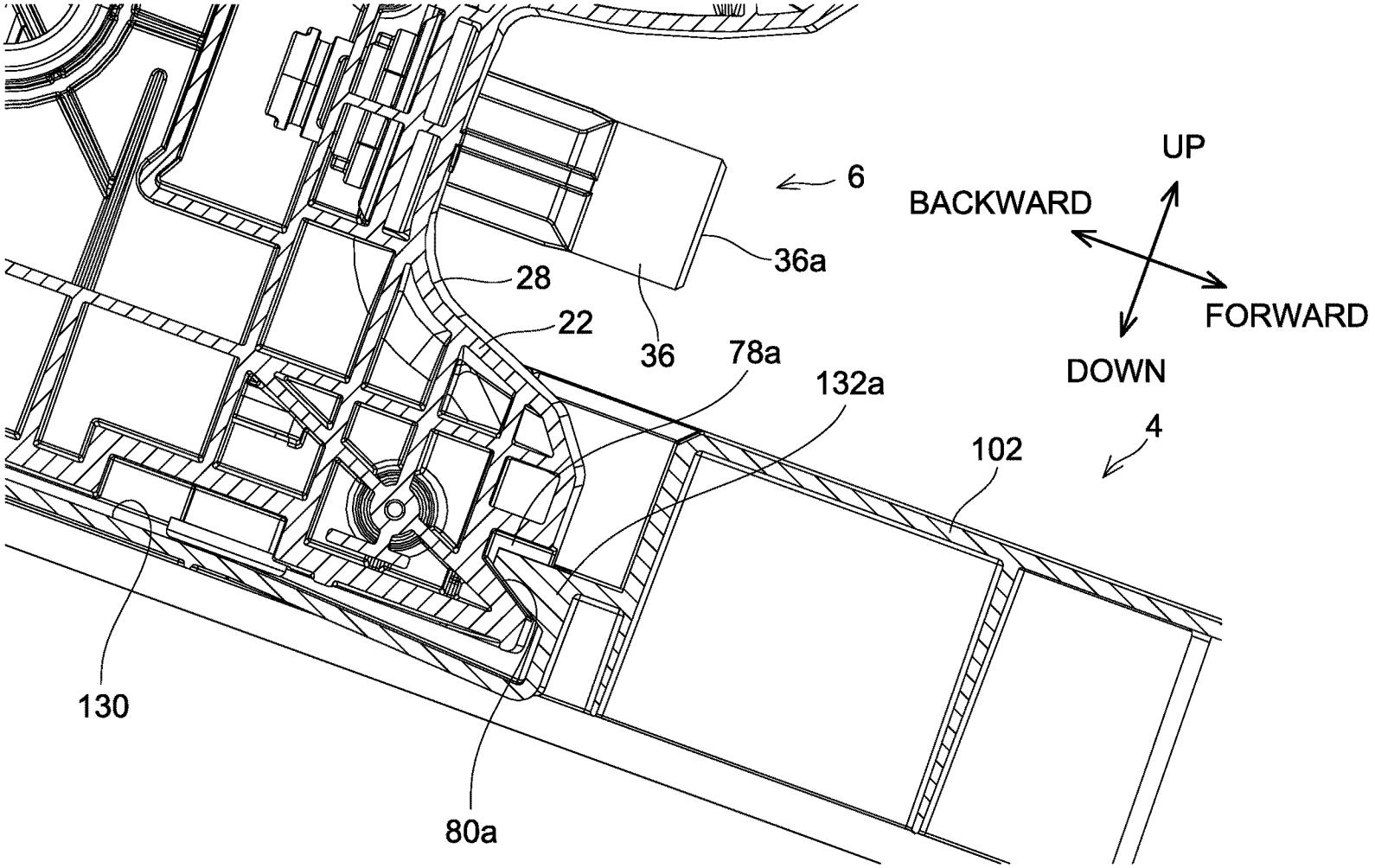
FIG. 21 is a vertical cross-sectional view of the pressure washer 2 according to the embodiment seeing the vicinity of the engaging groove 78*a* and the engaging pawl 132*a* in the state where the user is gripping the handle 122 and carrying the accommodation case 4 under the state where the washer body 6 is mounted on the accommodation case 4.
Figure 22:
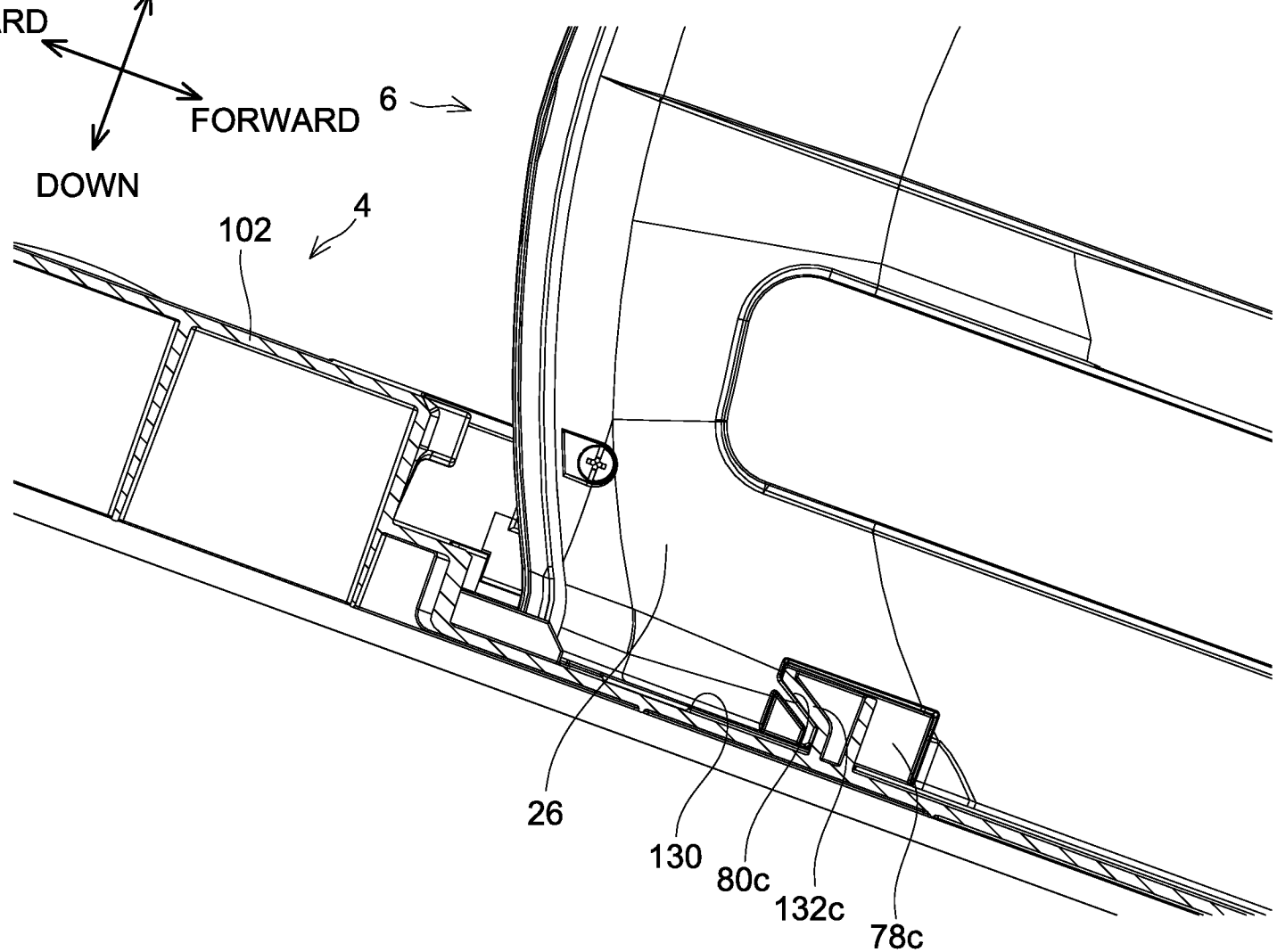
FIG. 22 is a vertical cross-sectional view of the pressure washer 2 according to the embodiment seeing the vicinity of the engaging groove 78*c* and the engaging pawl 132*c* in the state where the user is gripping the handle 122 and carrying the accommodation case 4 under the state where the washer body 6 is mounted on the accommodation case 4.

As shown in FIG. 20, in the pressure washer 2 of the present embodiment, even in the state of the washer body 6 being attached onto the upper surface of the accommodation case 4, the user can carry the accommodation case 4 using the rotations of the wheels 124*a*, 124*b* by gripping the handle 122 and tilting the accommodation case 4. In this case, as shown in FIGS. 21 and 22, since a component of gravity acting on the washer body 6 acts in a direction that moves the washer body 6 frontward with respect to the accommodation case 4, the engaging pawls 132*a*, 132*b*, 132*c* are strongly pressed against the engaging walls 80*a*, 80*b*, 80*c*. Due to this, upon carrying the accommodation case 4 with the washer body 6 mounted on its upper surface, the washer body 6 can be prevented from being detached from the accommodation case 4. In the pressure washer 2 of the present embodiment, even when water is not stored in the accommodation case 4, and the washer body 6 and the various accessories are accommodated within the accommodation case 4 as shown in FIGS. 15 and 16, the user can carry the accommodation case 4 using the rotations of the wheels 124*a*, 124*b* by gripping the handle 122 and tilting the accommodation case 4.

In the above embodiment, a configuration was described in which the washer body 6 is fixed to the accommodation case 4 by the engaging walls 80*a*, 80*b*, 80*c* being engaged with the engaging pawls 132*a*, 132*b*, 132*c* when the washer body 6 is mounted on the upper surface of the accommodation case 4, however alternatively a configuration may be also employed in which, for example, a permanent magnet (not shown) is provided on one of the accommodation case 4 and the washer body 6 and a magnetic body (not shown) is provided on the other of the accommodation case 4 and the washer body 6 such that the washer body 6 is fixed on the accommodation case 4 by magnetic force acting between the permanent magnet and the magnetic body.

In one or more aspects of the present teachings, the pressure washer 2 (example of the working machine) comprises the accommodation case 4 (example of a case) configured to store water, and the washer body 6 (example of a working machine body) configured to discharge water supplied from the accommodation case 4. The washer body 6 is detachably mounted on the upper surface of the accommodation case 4.

According to the above configuration, since the washer body 6 is mounted on the upper surface of the accommodation case 4 that stores water, the washer body 6 does not support weight of the accommodation case 4 storing water. Thus, even when a capacity of water stored in the accommodation case 4 is increased, strength and stiffness of the washer body 6 do not have to be increased. The capacity of water stored in the accommodation case 4 can be increased without increasing the size and weight of the washer body 6.

In one or more aspects of the present teachings, in the pressure washer 2, in a state where the accommodation case 4 is inclined with respect to a horizontal state, force that prevents the washer body 6 from moving in a direction of detaching the washer body 6 from the accommodation case 4 acts on the washer body 6 more strongly than when the accommodation case 4 is in the horizontal state.

According to the above configuration, in a case where the accommodation case 4 is inclined in the state where the washer body 6 is mounted on the upper surface of the accommodation case 4, force that prevents the washer body 6 from moving in the direction of detaching the washer body 6 from the accommodation case 4 acts on the washer body 6. Due to this, the washer body 6 mounted on the upper surface of the accommodation case 4 can be prevented from falling off the accommodation case 4 when the accommodation case 4 is inclined. Further, according to the above configuration, when the accommodation case 4 is in the horizontal state, the force that prevents the washer body 6 from moving in the direction of detaching the washer body 6 from the accommodation case 4 does not act on the washer body 6. Due to this, attachment and detachment of the washer body 6 can be easily performed when the accommodation case 4 is in the horizontal state.

In one or more aspects of the present teachings, one of the washer body 6 and the accommodation case 4 includes the engaging walls 80*a*, 80*b*, 80*c*. Another of the washer body 6 and the accommodation case 4 includes the engaging pawls 132*a*, 132*b*, 132*c* configured to engage with the engaging walls 80*a*, 80*b*, 80*c*. When the accommodation case 4 is in the horizontal state, weight of the washer body 6 does not act in a direction of pressing the engaging walls 80*a*, 80*b*, 80*c* against the engaging pawls 132*a*, 132*b*, 132*c*. When the accommodation case 4 is inclined with respect to the horizontal state, the weight of the washer body 6 acts in the direction of pressing the engaging walls 80*a*, 80*b*, 80*c* against the engaging pawls 132*a*, 132*b*, 132*c*.

According to the above configuration, upon detaching the washer body 6 from the accommodation case 4, the washer body 6 needs to be moved in a direction of detaching the engaging walls 80*a*, 80*b*, 80*c* from the engaging pawls 132*a*, 132*b*, 132*c*. At this occasion, if the accommodation case 4 is in the inclined state, weight of the washer body 6 acts in a direction that presses the engaging walls 80*a*, 80*b*, 80*c* against the engaging pawls 132*a*, 132*b*, 132*c*, i.e., i.e., the direction opposite to the direction of detaching the washer body 6 from the accommodation case 4. Due to this, the weight of the washer body 6 functions as the force that prevents the washer body 6 from moving in the direction of detaching the washer body 6 from the accommodation case 4. Further, in the above configuration, when the accommodation case 4 is in the horizontal state, the weight of the washer body 6 does not act in the direction of pressing the engaging walls 80*a*, 80*b*, 80*c* against the engaging pawls 132*a*, 132*b*, 132*c*, thus the weight of the washer body 6 does not function as the force that prevents the washer body 6 from moving in the direction of detaching the washer body 6 from the accommodation case 4. According the above configuration, with a simple structure, the force that prevents the washer body 6 from moving in the direction of detaching the washer body 6 from the accommodation case 4 can be made to act on the washer body 6 more strongly when the accommodation case 4 is in the inclined state relative to the horizontal state than when the accommodation case 4 is in the horizontal state.

In one or more aspects of the present teachings, the accommodation case 4 includes: the case body 100 having an opening on an upper side thereof; and the case cover 102 openably attached to the case body 100 and configured to cover the opening of the case body 100. The washer body 6 is detachably mounted on the upper surface of the case cover 102.

According to the above configuration, with the accommodation case 4 in the state of having the washer body 6 detached therefrom, the user can open/close the case cover 102 while remaining standing in a state where the case body 100 is placed on the ground.

In one or more aspects of the present teachings, the pressure washer 2 (example of the working machine) comprises: the accommodation case 4 (example of the case) configured to store water therein; the washer body 6 (example of the working machine body) configured to discharge water supplied from the case; and an accessory. In a state where water is not stored in the accommodation case 4, the washer body 6 and the accessory can be accommodated inside the accommodation case 4. The accommodation case 4 includes the drain port 118. The accessory includes the batteries 38*a*, 38*b* configured to supply electric power to the washer body 6. When the washer body 6 and the batteries 38*a*, 38*b* are accommodated inside the accommodation case 4, the batteries 38*a*, 38*b* are located above the drain port 118.

According to the above configuration, even when water remains at a position lower than the drain port 118 inside the accommodation case 4 after the water has been drained from the accommodation case 4 storing the water via the drain port 118 and the washer body 6 and accessorie(s) have been accommodated inside the accommodation case 4, the batteries 38*a*, 38*b* can be prevented from being splashed with water because the batteries 38*a*, 38*b* are arranged at a spot higher than the drain port 118.

In one or more aspects of the present teachings, the accessory further includes the charger 39 configured to charge the batteries 38*a*, 38*b*. When the washer body 6 and the charger 39 are accommodated inside the accommodation case 4, the charger 39 is located above the drain port 118.

According to the above configuration, even when water remains at a position lower than the drain port 118 inside the accommodation case 4 after the water has been drained from the accommodation case 4 storing the water via the drain port 118 and the washer body 6 and accessorie(s) have been accommodated inside the accommodation case 4, the charger 39 can be prevented from being splashed with water because the charger 39 is arranged at a spot higher than the drain port 118.

In one or more aspects of the present teachings, the support wall 128 (example of a support) configured capable of supporting the charger 39 above the drain port 118 is provided inside the accommodation case 4.

According to the above configuration, when the washer body 6 and accessorie(s) are accommodated in the accommodation case 4 after water has been drained from the accommodation case 4 storing water through the drain port 118, the charger 39 can be arranged surely at the spot higher than the drain port 118 by supporting the charger 39 with the support wall 128.

In one or more aspects of the present teachings, the positioning grooves 76*a*, 76*b* are provided on one of the lower surface of the washer body 6 and the bottom surface of the accommodation case 4. The positioning projections 126*a*, 126*b* configured to enter into the positioning grooves 76*a*, 76*b* are provided on another of the lower surface of the washer body 6 and the bottom surface of the accommodation case 4. When the washer body 6 is placed on the bottom surface of the accommodation case 4 in a correct orientation with the positioning grooves 76*a*, 76*b* and the positioning projections 126*a*, 126*b* being aligned with each other, the wall surface of the accommodation case 4 does not interfere with the washer body 6. When the washer body 6 is placed on the bottom surface of the accommodation case 4 in an incorrect orientation with the positioning grooves 76*a*, 76*b* and the positioning projections 126*a*, 126*b* being aligned with each other, the wall surface of the accommodation case 4 interferes with the washer body 6.

In a case where the washer body 6 and the accessorie(s) are accommodated in the accommodation case 4, the accessorie(s) are accommodated in the space defined between the washer body 6 placed on the bottom surface of the accommodation case 4 and the wall surface of the accommodation case 4. Due to this, if the orientation of the washer body 6 is different when the washer body 6 is placed on the bottom surface of the accommodation case 4, a shape of the space in which the accessorie(s) can be accommodated also becomes different. Due to this, if the washer body 6 is placed on the bottom surface of the accommodation case 4 in an incorrect orientation, there is a risk that all the accessories cannot be accommodated in the accommodation case 4. According to the above configuration, the washer body 6 can be prevented from being placed on the bottom surface of the accommodation case 4 in the incorrect orientation, thus the accessories can be surely accommodated within the accommodation case 4.

In one or more aspects of the present teachings, the washer body 6 (example of the working machine body) includes: the pump mechanism 60 configured to pump water supplied from the water inlet 34*a* to the water outlet 36*a*; the electric motor 56 configured to drive the pump mechanism 60; the housing 27 configured to accommodate the pump mechanism 60 and the electric motor 56 therein; and the shoulder belt 74 attached to the housing 27.

According to the above configuration, the user can carry the washer body 6 by strapping the shoulder belt 74 over his/her shoulder. The user can carry the washer body 6 without occupying one hand of the user.

In one or more aspects of the present teachings, the housing 27 includes the accessory box 26 configured to accommodate an accessory therein.

According to the above configuration, the user can carry also the accessorie(s) accommodated in the accessory box 26 together with the washer body 6 by carrying the washer body 6 by strapping the shoulder belt 74 over his/her shoulder.

In one or more aspects of the present teachings, the housing 27 includes: a portion of the support plate 72 at which the through hole 72*a* is formed (example of a first hook), in which one end of the shoulder belt 74 is detachably attached to that portion, and the support pin 70 (example of a second hook) to which another end of the shoulder belt 74 is detachably attached.

According to the above configuration, the shoulder belt 74 can be detached from the housing 27 when the shoulder belt 74 is unnecessary.

In one or more aspects of the present teachings, the support plate 72 is disposed on a front-upper side from a center of gravity of the washer body 6, and the support pin 70 is disposed on a rear-upper side from the center of gravity of the washer body 6.

According to the above configuration, upon the user carrying the washer body 6 by strapping the shoulder belt 74 over his/her shoulder, the washer body 6 can be easily balanced in the front-rear direction.

In one or more aspects of the present teachings, a position of the center of gravity of the washer body 6 in a left-right direction is located within a range of 1.5 times a width of the portion of the support plate 72 at which the through hole 72*a* is formed in the left-right direction from a centerline of the portion of the support plate 72 at which the through hole 72*a* is formed, and within a range of 1.5 times a width of the support pin 70 in the left-right direction from a centerline of the support pin 70.

According to the above configuration, upon the user carrying the washer body 6 by strapping the shoulder belt 74 over his/her shoulder, the washer body 6 can be easily balanced in the left-right direction.

In one or more aspects of the present teachings, the accommodation case 4 (example of the case) includes: the case body 100 configured to store water therein; the wheels 124*a*, 124*b* provided on the case body 100; and the handle 122 provided on the case body 100.

According to the above configuration, even when the capacity of water stored in the case body 100 is increased and thus the weight of the case body 100 storing water becomes significantly large, the user can easily carry the case body 100 by gripping the handle 122 without fully lifting the case body 100 up since the wheels 124*a*, 124*b* are provided on the case body 100.

In one or more aspects of the present teachings, the wheels 124*a*, 124*b* are provided in vicinity of one end of the case body 100. The handle 122 is provided in vicinity of another end of the case body 100. When the case body 100 is placed on the ground, the wheels 124*a*, 124*b* are separated from the ground. When the other end of the case body 100 is lifted upward, the wheels 124*a*, 124*b* come into contact with the ground.

According to the above configuration, since the wheels 124*a*, 124*b* are separated from the ground in the state where the case body 100 is placed on the ground, the case body 100 can be stably placed. Further, according to the above configuration, the wheels 124*a*, 124*b* come into contact with the ground when the user lifts the other end of the case body 100 upward by gripping the handle 122, by which the user can easily carry the case body 100.

In one or more aspects of the present teachings, the case body 100 includes the drain port 118 provided in vicinity of the one end of the case body 100.

According to the above configuration, upon draining the water stored in the case body 100 from the drain port 118, by the user lifting the other end of the case body 100 upward by gripping the handle 122, the draining of water from the drain port 118 arranged on one end of the case body 100 can be accelerated.

In one or more aspects of the present teachings, the accommodation case 4 includes: the case cover 102 which is openably attached to the case body 100 and configured to cover an opening provided on an upper side of the case body 100; and the sealer 110 disposed at a spot where the case cover 102 and the case body 100 contact each other.

According to the above configuration, the user can open/close the case cover 102 while remaining standing in the state where the case body 100 is placed on the ground. Further, according to the above configuration, even when the other end of the case body 100 is lifted upward by gripping the handle 122 in the state of the case body 100 storing the water, since the sealer 110 is arranged at the spot where the case cover 102 and the case body 100 are in contact with each other, water leaks from a gap between the case cover 102 and the case body 100 can be suppressed.

In one or more aspects of the present teachings, the pressure washer 2 (example of the working machine) comprises: the accommodation case 4; and the washer body 6 (example of the working machine body) configured to discharge water supplied from the accommodation case 4. The washer body 6 can be mounted on an upper surface of the accommodation case 4. The accommodation case 4 is carriable without fully lifting the accommodation case 4 in a state where the washer body 6 is mounted on the upper surface of the accommodation case 4.

According to the above configuration, the accommodation case 4 storing water and the washer body 6 can be carried together in the state where the washer body 6 is mounted on the upper surface of the accommodation case 4.

In one or more aspects of the present teachings, in a state where water is not stored in the accommodation case 4, the washer body 6 can be accommodated inside the accommodation case 4. The accommodation case 4 is carriable without fully lifting the accommodation case 4 in a state where the washer body 6 is accommodated inside the accommodation case 4.

According to the above configuration, the accommodation case 4 and the washer body 6 can be carried together in the state where the washer body 6 is accommodated within the accommodation case 4.

In one or more aspects of the present teachings, the pressure washer 2 (example of the working machine) comprises: the accommodation case 4; and the washer body 6 configured to discharge water supplied from the accommodation case 4. In a state where water is not stored in the accommodation case 4, the washer body 6 can be accommodated inside the accommodation case 4. The accommodation case 4 is carriable without fully lifting the accommodation case 4 in a state where the washer body 6 is accommodated inside the accommodation case 4.

According to the above configuration, the accommodation case 4 and the washer body 6 can be carried together in the state where the washer body 6 is accommodated inside the accommodation case 4.

What is claimed is:

1. A pressure washer comprising:

a case configured to store water therein; and a working machine body configured to discharge water supplied from the case, wherein the working machine body is detachably mounted on an upper surface of the case, one of the working machine body and the case includes an engaging wall, another of the working machine body and the case includes an engaging pawl configured to engage with the engaging wall, when the case is in a horizontal state, a weight of the working machine body does not act in a direction of pressing the engaging wall against the engaging pawl, when the case is inclined with respect to the horizontal state, the weight of the working machine body acts in the direction of pressing the engaging wall against the engaging pawl, the working machine body is configured to be detached from the case by the working machine body being lifted in both of a state where the case is inclined with respect to the horizontal state and a state where the case is in the horizontal state, when the case is inclined with respect to the horizontal state, a force that prevents the working machine body from moving in a direction of detaching the working machine body from the case acts on the working machine body more strongly than when the case is in the horizontal state, the pressure washer further comprises an accessory, wherein in a state where water is not stored in the case, the working machine body and the accessory can be accommodated inside the case, the case includes a drain port, the accessory includes a battery configured to supply electric power to the working machine body, when the working machine body and the battery are accommodated inside the case, the battery is located above the drain port, a positioning groove is provided on one of a lower surface of the working machine body and a bottom surface of the case, a positioning projection configured to enter into the positioning groove is provided on another of the lower surface of the working machine body and the bottom surface of the case, when the working machine body is placed on the bottom surface of the case in a correct orientation with the positioning groove and the positioning projection being aligned with each other, a wall surface of the case does not interfere with the working machine body, and when the working machine body is placed on the bottom surface of the case in an incorrect orientation with the positioning groove and the positioning projection being aligned with each other, the wall surface of the case interferes with the working machine body.

2. The pressure washer according to claim 1, wherein the case includes:

a case body having an opening on an upper side thereof; and a case cover openably attached to the case body and configured to cover the opening of the case body, and the working machine body is detachably mounted on an upper surface of the case cover.

3. The pressure washer according to claim 1, wherein the accessory further includes a charger configured to charge the battery, and when the working machine body and the charger are accommodated inside the case, the charger is located above the drain port.

4. The pressure washer according to claim 3, wherein a support configured to be capable of supporting the charger above the drain port is provided inside the case.

5. The pressure washer according to claim 1, wherein the working machine body includes:

a pump mechanism configured to pump water supplied from a water inlet to a water outlet;

an electric motor configured to drive the pump mechanism;

a housing configured to accommodate the pump mechanism and the electric motor therein; and a shoulder belt attached to the housing.

6. The pressure washer according to claim 5, wherein the housing includes an accessory box configured to accommodate an additional accessory therein.

7. The pressure washer according to claim 5, wherein the housing includes:

a first hook to which one end of the shoulder belt is detachably attached, and a second hook to which another end of the shoulder belt is detachably attached.

8. The pressure washer according to claim 7, wherein the first hook is disposed on a front-upper side from a center of gravity of the working machine body, and the second hook is disposed on a rear-upper side from the center of gravity of the working machine body.

9. The pressure washer according to claim 7, wherein a position of the center of gravity of the working machine body in a left-right direction is located within a range of 1.5 times a width of the first hook in the left-right direction from a centerline of the first hook, and within a range of 1.5 times a width of the second hook in the left-right direction from a centerline of the second hook.

10. The pressure washer according to claim 1, wherein the case includes:

a case body configured to store water therein;

a wheel provided on the case body; and a handle provided on the case body.

11. The pressure washer according to claim 10, wherein the wheel is provided in vicinity of one end of the case body, the handle is provided in vicinity of another end of the case body, when the case body is placed on a ground, the wheel is separated from the ground, and when the other end of the case body is lifted upward, the wheel comes into contact with the ground.

12. The pressure washer according to claim 10, wherein the case body includes the drain port and the drain port is provided in vicinity of the one end of the case body.

13. The pressure washer according to claim 10, wherein the case includes:

a case cover which is openably attached to the case body and configured to cover an opening provided on an upper side of the case body; and a sealer disposed at a spot where the case cover and the case body contact each other.

14. The pressure washer according to claim 10, wherein the case is carriable without fully lifting the case in a state where the working machine body is mounted on the upper surface of the case.

15. The pressure washer according to claim 14, wherein in a state where water is not stored in the case, the working machine body can be accommodated inside the case, and the case is carriable without fully lifting the case in a state where the working machine body is accommodated inside the case.

16. The pressure washer according to claim 10, wherein in a state where water is not stored in the case, the working machine body can be accommodated inside the case, and the case is carriable without fully lifting the case in a state where the working machine body is accommodated inside the case.

17. A pressure washer comprising:

a case configured to store water therein; and a working machine body configured to discharge water supplied from the case, wherein the working machine body is detachably mounted on an upper surface of the case, one of the working machine body and the case includes an engaging wall, another of the working machine body and the case includes an engaging pawl configured to engage with the engaging wall, when the case is in a horizontal state, a weight of the working machine body does not act in a direction of pressing the engaging wall against the engaging pawl, when the case is inclined with respect to the horizontal state, the weight of the working machine body acts in the direction of pressing the engaging wall against the engaging pawl, the working machine body is configured to be detached from the case by the working machine body being lifted in both of a state where the case is inclined with respect to the horizontal state and a state where the case is in the horizontal state, when the case is inclined with respect to the horizontal state, a force that prevents the working machine body from moving in a direction of detaching the working machine body from the case acts on the working machine body more strongly than when the case is in the horizontal state, the pressure washer further comprises an accessory, wherein in a state where water is not stored in the case, the working machine body and the accessory can be accommodated inside the case, the case includes a drain port, the accessory includes a battery configured to supply electric power to the working machine body, when the working machine body and the battery are accommodated inside the case, the battery is located above the drain port, the accessory further includes a charger configured to charge the battery, when the working machine body and the charger are accommodated inside the case, the charger is located above the drain port, and a support configured to be capable of supporting the charger above the drain port is provided inside the case.

* * * * *